US010114309B2

(12) United States Patent
Ikari

(10) Patent No.: US 10,114,309 B2
(45) Date of Patent: Oct. 30, 2018

(54) INFORMATION PROCESSING APPARATUS, IMAGE FORMING APPARATUS, METHOD OF ADJUSTING IMAGE FORMATION START POSITION IN MAIN SCANNING DIRECTION OF IMAGE FORMING APPARATUS, AND STORAGE MEDIUM

(71) Applicant: CANON KABUSHIKI KAISHA, Tokyo (JP)

(72) Inventor: Daiki Ikari, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/247,585

(22) Filed: Aug. 25, 2016

(65) Prior Publication Data

US 2017/0060020 A1 Mar. 2, 2017

(30) Foreign Application Priority Data

Sep. 1, 2015 (JP) ..... 2015-172138
Jul. 13, 2016 (JP) ..... 2016-138498

(51) Int. Cl.
*G03G 15/00* (2006.01)
*G03G 15/043* (2006.01)

(52) U.S. Cl.
CPC ..... *G03G 15/043* (2013.01)

(58) Field of Classification Search
CPC ..... G03G 15/043; G02B 26/122
USPC ..... 399/4
See application file for complete search history.

(56) References Cited

U.S. PATENT DOCUMENTS

2011/0205271 A1* 8/2011 Sai ..... B41J 19/202 347/9
2015/0338764 A1* 11/2015 Kodama ..... G03G 15/043 347/118

FOREIGN PATENT DOCUMENTS

JP 2005-096351 4/2005

* cited by examiner

*Primary Examiner* — Walter L Lindsay, Jr.
*Assistant Examiner* — Ruth Labombard
(74) *Attorney, Agent, or Firm* — Fitzpatrick, Cella, Harper & Scinto

(57) ABSTRACT

To reduce a deviation in a scanning start position in the case where image formation is performed by an electrophotographic scheme in which a scanning speed of laser beam is not uniform on a photoconductor surface. An information processing apparatus includes a generation unit configured to generate a scanning speed profile, which is information about a scanning speed for each main scanning position in an image forming apparatus in which the scanning speed of laser beam is not uniform on a photoconductor surface; and a derivation unit configured to derive a scanning position adjustment amount specifying a distance from a reference position in a main scanning direction of the laser beam to a write start position of laser beam to the photoconductor surface based on the generated scanning speed profile in the main scanning direction.

16 Claims, 18 Drawing Sheets

| DATA | PARTIAL MAGNIFICATION [%] | 138 | 137 | 136 | | 101 | 100 | 101 | | 134 | 134 | 135 |
|---|---|---|---|---|---|---|---|---|---|---|---|---|
| ADDRESS | MAIN SCANNING POSITION [pixel] | 0 | 1 | 2 | | 4095 | 4096 | 4097 | | 8189 | 8190 | 8191 |

FIG.14

INFORMATION PROCESSING APPARATUS, IMAGE FORMING APPARATUS, METHOD OF ADJUSTING IMAGE FORMATION START POSITION IN MAIN SCANNING DIRECTION OF IMAGE FORMING APPARATUS, AND STORAGE MEDIUM

BACKGROUND OF THE INVENTION

Field of the Invention

The present invention relates to a technique to adjust a write start position of laser beam in an electrophotographic image forming apparatus.

Description of the Related Art

An electrophotographic image forming apparatus has an optical scanning unit for exposing a photoconductor. The optical scanning unit irradiates and exposes a photoconductor with laser beam by emitting the laser beam based on image data, causing a rotating polygon mirror to reflect the emitted laser beam, and causing the laser beam to pass through a scanning lens. Then, a latent image is formed on the photoconductor by performing scanning to move the spot of the laser beam formed on the surface of the photoconductor by rotating the rotating polygon mirror.

Normally, as a scanning lens, a lens having so-called fθ characteristics is used. Here, the fθ characteristics are optical characteristics that form an image of laser beam on the surface of a photoconductor by moving the spot of the laser beam on the surface of the photoconductor at a uniform speed on the surface of the photoconductor while a rotating polygon mirror is rotating at a uniform angular speed. By using a scanning lens having such fθ characteristics, it is possible to perform appropriate exposure. However, the scanning lens having the fθ characteristics is comparatively large and expensive. Because of this, with a view to downsizing the image forming apparatus and to reducing its cost, not using the scanning lens itself or using a scanning lens not having the fθ characteristics has been discussed.

In the case where a scanning lens not having the fθ characteristics is used, the spot of laser beam does not move on the surface of a photoconductor at a uniform speed in the scanning direction (main scanning direction) in which the laser beam scans on the surface of the photoconductor. Because of this, there is such a problem that the width of a dot formed on the photoconductor surface is not uniform. For this problem, there has been proposed a technique to form a latent image equivalent to that in the case where the spot of laser beam scans on the surface of a photoconductor at a uniform speed by correcting the image data corresponding to each exposure position of the laser beam in the main scanning direction in accordance with the exposure position. For example, Japanese Patent Laid-Open No. 2005-096351 has disclosed a technique to add image data to image data configuring a PWM lighting pattern or to remove image data from the PWM lighting pattern so that an image with a desired width is formed on the surface of a photoconductor in an electrophotographic image forming apparatus. The image forming apparatus described in Japanese Patent Laid-Open No. 2005-096351 generates 16-bit bit data from density data representing density tone levels. The image forming apparatus adds bit data to the generated 16-bit bit data or deletes bit data from the 16-bit bit data.

As described above, in an image forming apparatus using a scanning lens not having the fθ characteristics, laser beam on the surface of a photoconductor does not move at a uniform speed. Because of this, the scanning movement amount based on an image clock that serves as a reference of scanning varies depending on the scanning position. That is, the distance traveled by laser beam in one period of the image clock varies depending on the scanning position. The adjustment of the scanning position is performed by taking the image clock as a reference, and therefore, the unit of the adjustment amount also varies depending on the scanning position.

Regarding this point, the technique disclosed in Japanese Patent Laid-Open No. 2005-096351 described above does not take into consideration the change in the unit of the adjustment amount at the time of scanning position adjustment. Consequently, in the case where an attempt is made to start scanning of laser beam from a specified position, the scanning start position deviates due to the change in the unit of the adjustment amount. Then, in a general image forming apparatus, an arbitrary scanning start position is specified so that the center position of a latent image to be formed on the photoconductor and the center position of a printing medium align with each other, and therefore, the above-described deviation in the scanning start position will result in a deviation in the printing position of an image to be formed on the printing medium.

Further, even in the case where the same scanning start position is specified, there may be a slight variation in the scanning speed of laser beam on the photoconductor surface among image forming apparatuses due to the factor, such as an assembling error of each part. In this case, it is necessary to set an adjustment amount in accordance with the scanning speed characteristics in each individual image forming apparatus, but Japanese Patent Laid-Open No. 2005-096351 described above does not take into consideration the individual difference such as this among the image forming apparatuses.

SUMMARY OF THE INVENTION

The information processing apparatus according to the present invention includes a scanning speed profile generation unit configured to generate a scanning speed profile, which is information about a scanning speed for each main scanning position in an image forming apparatus in which the scanning speed of laser beam is not uniform on a photoconductor surface, and a scanning position adjustment amount derivation unit configured to derive a scanning position adjustment amount specifying a distance from a reference position in a main scanning direction of the laser beam to a write start position of laser beam to the photoconductor surface based on the generated scanning speed profile in the main scanning direction.

Further features of the present invention will become apparent from the following description of exemplary embodiments (with reference to the attached drawings).

BRIEF DESCRIPTION OF THE DRAWINGS

FIG. 14 is a diagram showing an example of a scanning speed profile;

DESCRIPTION OF THE EMBODIMENTS

Hereinafter, with reference to the attached drawings, the present invention is explained in detail in accordance with preferred embodiments. Configurations shown in the following embodiments are merely exemplary and the present invention is not limited to the configurations shown schematically.

First Embodiment

<Image Forming Apparatus>

Figure 1:
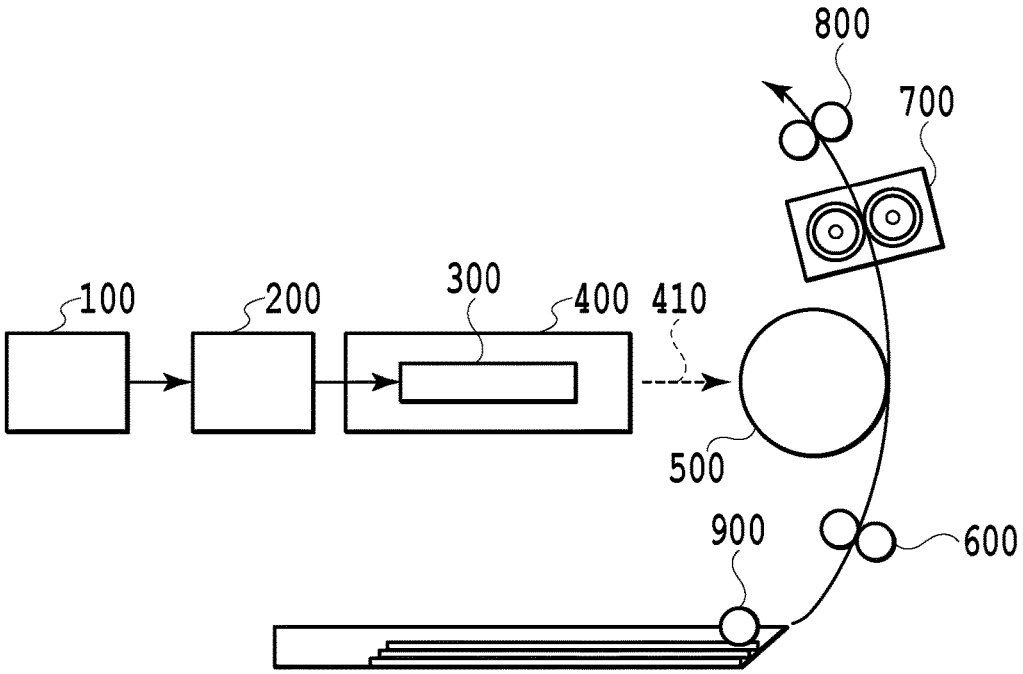
FIG. 1 is a configuration outline diagram of an image forming apparatus.

FIG. 1 is a configuration outline diagram of an image forming apparatus according to the present embodiment. A laser drive unit 300 within an optical scanning device 400 emits scanning light (laser beam) shown by a broken line arrow 410 toward a photoconductor drum 500 based on an image signal output from an image signal generation unit 100 and a control signal output from a control unit 200. Then, the photoconductor drum (photoconductor) 500 charged by a charging device, not shown, is scanned by the laser beam 410 and a latent image is formed on the surface of the photoconductor drum 500. Then, toner is attached to the latent image thus formed by a development device, not shown, and a toner image corresponding to the latent image is formed. The toner image is transferred onto a printing medium, such as paper, fed from a paper feed unit 900 and conveyed to a position by a roller 600 where the printing medium comes into contact with the photoconductor drum 500. The toner image transferred onto the printing medium is thermally fixed onto the printing medium by a fixing unit 700 and discharged to the outside of the apparatus through a paper discharge roller 800.

<Optical Scanning Device>

Figure 2A:
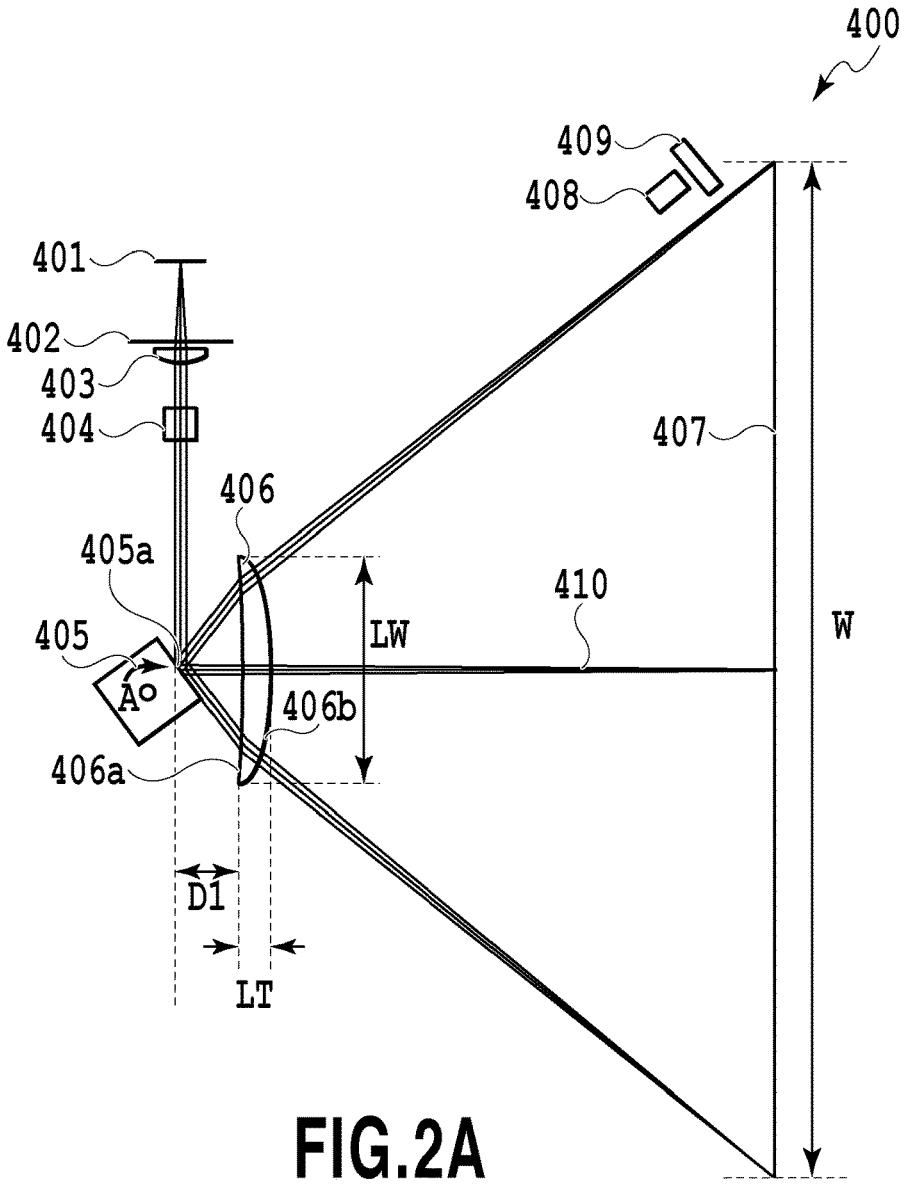
FIG. 2A and FIG. 2B are section diagrams of an optical scanning device, FIG. 2A showing a main scanning section and FIG. 2B showing a sub scanning section.
Figure 2B:
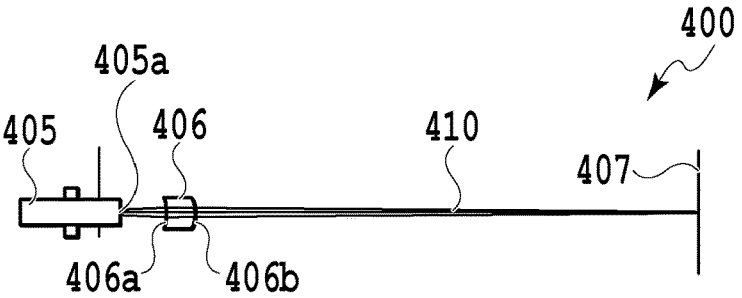

FIG. 2A and FIG. 2B are section diagrams of the optical scanning device 400 according to the present embodiment, FIG. 2A showing a main scanning section and FIG. 2B showing a sub scanning section.

In the present embodiment, the laser beam (light flux) 410 emitted from a light source 401 is shaped into the shape of an ellipse by an aperture stop 402 and enters a coupling lens 403. The light flux having passed through the coupling lens 403 is converted into substantially parallel light and enters an anamorphic lens 404. The anamorphic lens 404 has positive refractive power within the main scanning section and causes the incident laser beam to converge in the main scanning direction. Further, the anamorphic lens 404 collects the light flux in the vicinity of a deflecting surface 405*a* of a deflector 405 within the sub scanning section and forms a line image elongated in the main scanning direction.

Then, the light flux having passed through the anamorphic lens 404 is reflected from the deflecting surface (reflecting surface) 405*a* of the deflector (polygon mirror) 405. The light flux reflected from the reflecting surface 405*a* passes through an image forming lens 406 as the scanning light 410 (see FIG. 1) and enters the surface of the photoconductor drum 500. The image forming lens 406 is an image forming optical element. In the present embodiment, the image forming optical system is constituted by the single image forming optical element (image forming lens 406) alone. The surface of the photoconductor drum 500 entered by the laser beam having passed through (transmitted) the image forming lens 406 is a surface to be scanned 407 that is scanned by the light flux. By the image forming lens 406, the light flux forms an image on the surface to be scanned 407 and forms an image (spot) in the form of a predetermined spot. By rotating the deflector 405 in an arrow A direction at a fixed angular speed by a drive unit, not shown, the spot moves in the main scanning direction on the surface to be scanned 407 and an electrostatic latent image is formed on the surface to be scanned 407. The main scanning direction is the direction parallel to the surface of the photoconductor drum 500 and perpendicular to the direction of movement of the surface of the photoconductor drum 500. The sub scanning direction is the direction perpendicular to the main scanning direction and to the optical axis of the light flux.

A beam detect (hereinafter, referred to as BD) sensor 409 and a BD lens 408 are each an optical system for synchronization that determines timing at which an electrostatic latent image is written onto the surface to be scanned 407. The laser beam having passed through the BD lens 408 enters the BD sensor 409 including a photodiode and is detected. The DB sensor 409 generates a synchronization signal in response to reception of the laser beam. The image forming apparatus of the present embodiment controls exposure start timing of laser beam based on image data of one scanning period by taking the generation timing of a synchronization signal by the BD sensor 409 as a reference.

The various optical members described above, such as the light source 401, the coupling lens 403, the anamorphic lens 404, the image forming lens 406, and the deflector 405, are housed in a casing (optical box).

<Image Forming Lens>

As shown in FIG. 2A and FIG. 2B, the image forming lens 406 has two optical surfaces (lens surfaces): an incidence surface (first surface) 406*a* and an emission surface (second surface) 406*b*. The image forming lens 406 is configured to cause the laser beam deflected by the deflecting surface 405*a* within the main scanning section to scan with desired scanning characteristics on the surface to be scanned 407. Further, the image forming lens 406 is configured to shape the spot of the laser beam 410 into a desired shape on the surface to be scanned 407. Furthermore, due to the image forming lens 406, the vicinity of the deflecting surface 405*a* and the vicinity of the surface to be scanned 407 are brought into a conjugate relationship within the sub scanning section. Due to this, the configuration is such that a deviation in the scanning position in the sub scanning direction on the surface to be scanned 407 in the case where the deflecting surface 405*a* tilts is reduced.

The image forming lens 406 does not have the so-called fθ characteristics. That is, the image forming lens 406 does not have the scanning characteristics that cause the spot of the light flux passing through the image forming lens 406 to move at a uniform speed on the surface to be scanned 407 while the deflector 405 is rotating at a uniform angular speed. By using the image forming lens 406 not having the fθ characteristics as described above, it is made possible to arrange the image forming lens 406 in close proximity to the deflector 405 (in the position whose distance D1 is small). It is possible to reduce the size in the main scanning direction (width LW) and that in the optical axis direction (thickness LT) of the image forming lens 406 not having the fθ characteristics than those of an image forming lens having the fθ characteristics. Due to this, it is made possible to downsize the casing of the optical scanning device 400. For a lens having the fθ characteristics, there is a case where the shapes of the incidence surface and the emission surface of the lens viewed in the main scanning section change steeply, and therefore, there is a possibility that favorable image forming performance is not obtained due to the restrictions on the shape such as this. In contrast to this, for the image forming lens 406 not having the fθ characteristics, there is not a steep change in the shape of the incidence surface and the emission surface of the lens viewed in the main scanning section, and therefore, it is possible to obtain favorable image forming performance.

The scanning characteristics of the image forming lens 406 not having the fθ characteristics as described above are expressed by expression (1) below.

$$Y = \frac{K}{B}\tan(B\theta) \qquad \text{expression (1)}$$

In expression (1) described above, the scanning angle (scanning field angle) by the deflector 405 is taken to be θ, the light collection position (image height) in the main scanning direction on the surface to be scanned 407 of the light flux is taken to be Y [mm], the image formation coefficient at an on-axis image height is taken to be K [mm], and the coefficient (scanning characteristics coefficient) that determines the scanning characteristics of the image forming lens 406 is taken to be B. In the present embodiment, the on-axis image height refers to the image height (Y=0=Ymin) on the optical axis, corresponding to the scanning angle θ=0. Further, an off-axis image height refers to the image height (Y≠0) outside the central optical axis (in the case where the scanning angle θ=0), corresponding to the scanning angle θ≠0. Furthermore, an outermost off-axis image height refers to the image height (Y=+Ymax, −Ymax) in the case where the scanning angle θ reaches its maximum (maximum scanning field angle). A scanning width W, which is the width in the main scanning direction in a predetermined area (scanning area) where it is possible to form a latent image on the surface to be scanned 407, is expressed as W=|+Ymax|+|−Ymax|. The center of the predetermined area corresponds to the on-axis image height and the end corresponds to the outermost off-axis image height.

Here, the image formation coefficient K is a coefficient corresponding to f of the scanning characteristics (fθ characteristics) Y=fθ in the case where parallel light enters the image forming lens 406. That is, the image formation coefficient K is a coefficient for bringing the light collection position Y and the scanning angle θ into a proportional relationship like the fθ characteristics in the case where light flux other than parallel light enters the image forming lens 406.

Supplementary explanation is given as to the scanning characteristics coefficient. In the case where B=0, expression (1) described above becomes Y=Kθ, and therefore, the scanning characteristics coefficient corresponds to the scanning characteristics Y=fθ of an image forming lens having the fθ characteristics used for a conventional optical scanning device. Further, in the case where B=1, expression (1) described above becomes Y=K tan θ, and therefore, the scanning characteristics coefficient corresponds to the projection characteristics Y=f tan θ of a lens used for an image capturing apparatus (camera) or the like. That is, by setting the scanning characteristics coefficient B to a range of 0≤B≤1 in expression (1) described above, it is possible to obtain scanning characteristics between the projection characteristics Y=f tan θ and the fθ characteristics Y=fθ.

Here, by differentiating expression (1) described above with respect to the scanning angle θ, the scanning speed of laser beam on the surface to be scanned 407 for the scanning angle θ is obtained as shown in expression (2) below.

$$\frac{dY}{d\theta} = \frac{K}{\cos^2(B\theta)} \qquad \text{expression (2)}$$

Further, by dividing expression (2) described above by a speed dY/dθ=K at the on-axis image height, expression (3) as below is obtained.

$$\frac{\frac{dY}{d\theta}}{K} - 1 = \frac{1}{\cos^2(B\theta)} - 1 = \tan^2(B\theta) \qquad \text{expression (3)}$$

Expression (3) described above represents an amount of deviation (partial magnification) in the scanning speed at each off-axis image height with respect to the scanning speed at the on-axis image height. In the optical scanning device 400 according to the present embodiment, the scanning speed of light flux is different between the on-axis image height and the off-axis image height except in the case where B=0.

Figure 3:
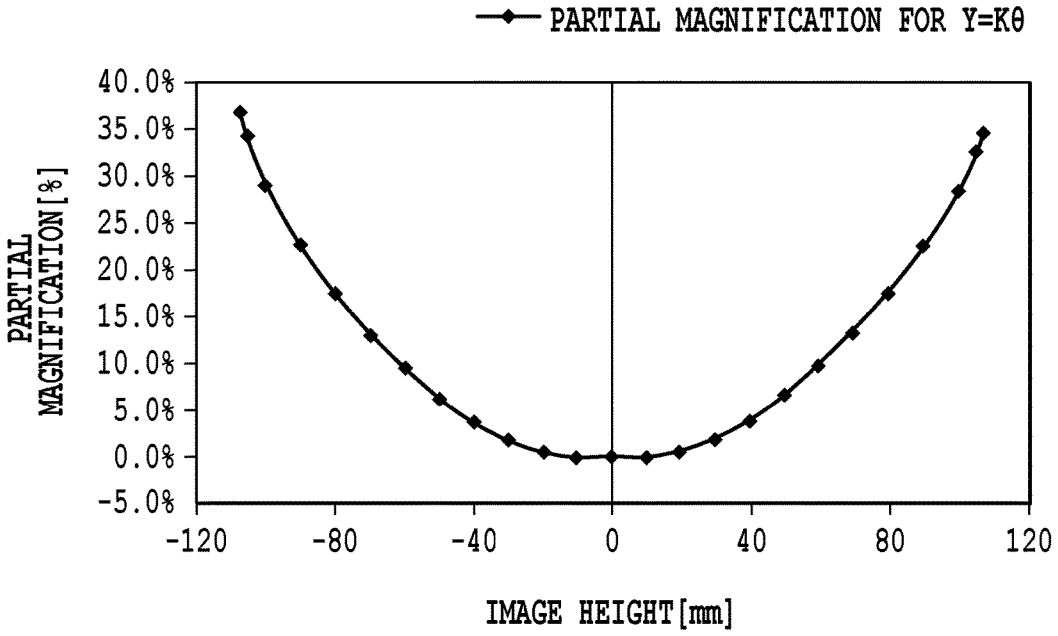
FIG. 3 is a diagram showing a relationship between an image height and a partial magnification in the case where a scanning position on a surface to be scanned is set with characteristics of $Y=K\theta$.

FIG. 3 shows a relationship between the image height and the partial magnification in the case where the scanning position on the surface to be scanned 407 is set with the characteristics of Y=Kθ. In the present embodiment, the scanning characteristics shown in expression (1) described above are given to the image forming lens 406, and therefore, the partial magnification becomes larger as the image height becomes more distant from the on-axis image height and becomes closer to the off-axis image height as shown in FIG. 3. The reason is that the scanning speed increases gradually as the image height becomes more distant from the on-axis image height and becomes closer to the off-axis image height. For example, the partial magnification 30% means that the irradiation length in the main scanning direction on the surface to be scanned 407 becomes 1.3 times the irradiation length, which is the reference on the surface to be scanned 407, in the case where light irradiation is performed for the unit period of time. In FIG. 3, the irradiation length (scanning speed) at the on-axis image height is taken to be the reference (partial magnification 0%). Consequently, in the case where the pixel width in the main scanning direction is determined with a fixed time interval determined by the period of the image clock, the pixel density differs between the on-axis image height and the off-axis image height.

Further, as the image height Y becomes more distant from the on-axis image height and becomes closer to the outermost off-axis image height (as the absolute value of the image height Y becomes greater), the scanning speeds increases gradually. Due to this, the time taken by scanning of the unit length in the case where the image height on the surface to be scanned 407 is close to the outermost off-axis image height becomes shorter than the time taken by scanning of the unit length in the case where the image height is close to the on-axis image height. This means that, in the case where the light emission luminance of the light source 401 is fixed, the total amount of exposure per unit length in the case where the image height is close to the outermost off-axis image height is smaller than the total amount of exposure per unit length in the case where the image height is close to the on-axis image height.

Figure 4A:
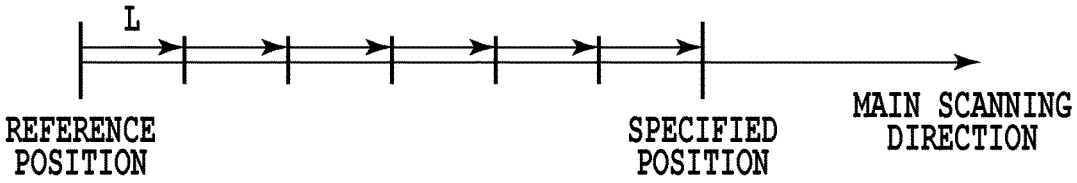
FIG. 4A and FIG. 4B are diagrams explaining a movement amount in the main scanning direction per period of an image clock, FIG. 4A showing the main scanning movement amount per period of an image forming apparatus in which the scanning speed is uniform, and FIG. 4B showing the main scanning movement amount per period of an image forming apparatus in which the scanning speed is not uniform.
Figure 4B:
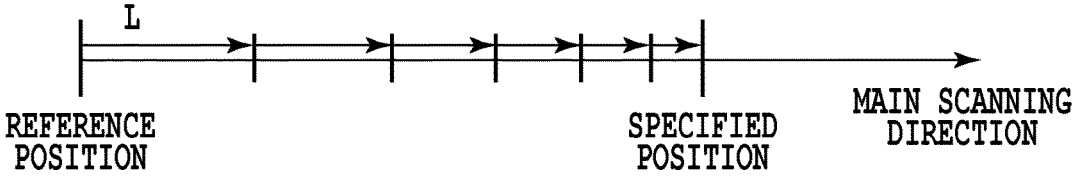

Further, the scanning speed differs depending on the scanning position, and therefore, the distance scanned in one period of the image clock is not fixed. In other words, the amount of movement of the main scanning in each period of the image clock differs depending on the main scanning position. This means that it is necessary to appropriately calculate the mount of movement in each period of the image clock for each main scanning position. FIG. 4A and FIG. 4B are diagrams explaining the amount of movement in the main scanning direction in each period of the image clock. FIG. 4A shows the main scanning movement amount in each period of the image forming apparatus in which the scanning speed is fixed. In the case where the scanning speed is fixed, for the distance from the position (reference position) of the BD sensor 409 to an arbitrary specified position (scanning start position) where scanning with the laser beam 410 starts, the distance to be scanned (an arrow L in FIG. 4A) in one period of the image clock is fixed. Consequently, it is possible to easily find the scanning position adjustment amount, which is represented by the number of cycles of the image clock that is necessary to reach the specified position from the reference position, by dividing the distance from the reference position to the specified position by L. On the other hand, FIG. 4B shows the main scanning movement amount in each period of the image clock of the image forming apparatus in which the scanning speed is not fixed (differs depending on the scanning position). In the case where the scanning speed differs depending on the scanning position, the distance to be scanned L in one period of the image clock is not fixed as shown in FIG. 4B, and the distance to be scanned L in one period of the clock becomes shorter as the distance from the reference position becomes greater. Consequently, it is not possible to appropriately calculate the above-described adjustment amount unless the scanning speed for each scanning position is taken into consideration.

Further, there is a difference (individual difference) in the characteristics of the scanning speed among the image forming apparatuses, and therefore, the appropriate adjustment amount for the dimension of distance from the reference position to the specified position differs for each image forming apparatus. The calculation method of the above-described adjustment amount in the case where the scanning speed is not fixed will be described later.

As described above, in the case of an optical configuration employing an image forming lens not having the fθ characteristics, favorable image formation onto a printing medium may be impeded by the variations in the partial magnification in the main scanning direction and in the total amount of exposure per unit length, and the difference in the scanning movement amount per period of the image clock. Consequently, in the present embodiment, in order to implement favorable image formation onto a printing medium also in an optical configuration employing an image forming lens not having the fθ characteristics, correction of the partial magnification, correction of the total amount of exposure per unit length (correction of luminance), and adjustment of the scanning start position are performed. Among others, in the present embodiment, the adjustment of the scanning start position is the most important element.

<Exposure Control>

Figure 5:
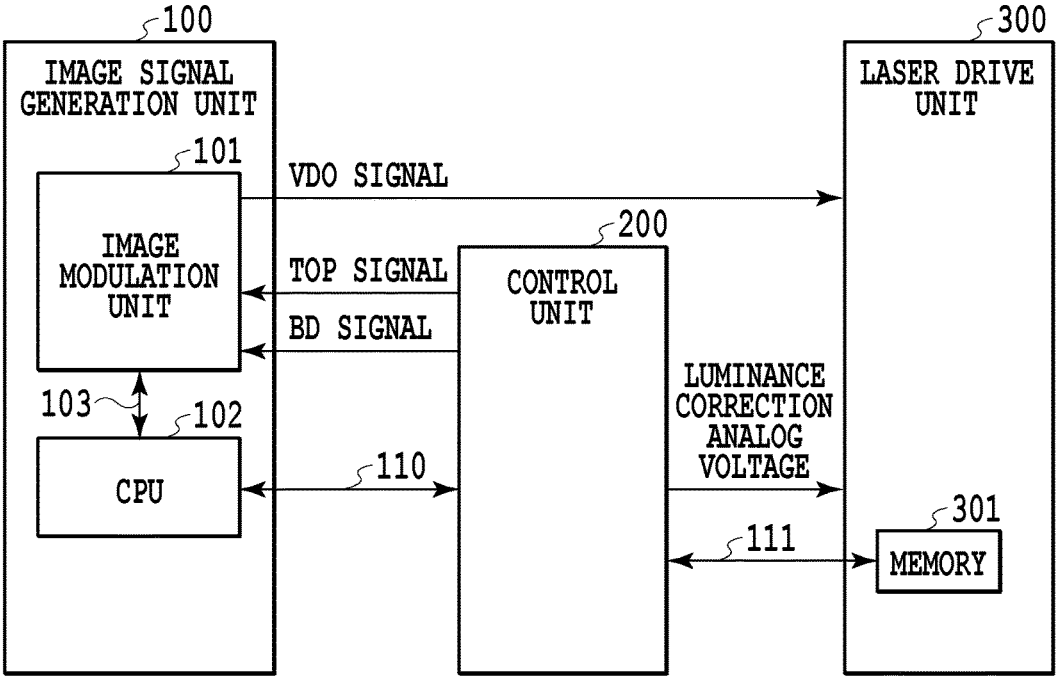
FIG. 5 is a block diagram showing details of a portion in charge of exposure control in an image forming apparatus according to a first embodiment.

FIG. 5 is a block diagram showing details of the portion in charge of exposure control in the image forming apparatus of the present embodiment. The image signal generation unit 100 includes an image modulation unit 101, a CPU 102, and a CPU bus 103. The image modulation unit 101 receives print information from a document reader, not shown, attached to a host computer, not shown, or the image forming apparatus. The image modulation unit 101 generates image data representing density tone levels based on the print information and converts the generated image data into a bit pattern (drive data). A signal output by the image modulation unit 101, which is bit data included in the bit pattern output in synchronization with a high-frequency clock, to be described later, is a VDO signal (PWM signal). In the ROM or the like (not shown), control programs for causing the image signal generation unit 100 to perform the above-described operations are stored. The CPU 102 controls the image modulation unit 101 in accordance with the control programs. The control unit 200 performs light amount control of laser beam emitted by the light source 401 as well as controlling the entire image forming apparatus. The laser drive unit 300 causes the light source 401 to emit light by supplying a current to the light source 401 based on the above-described VDO signal.

The image signal generation unit 100 sends instructions to start printing to the control unit 200 through serial communication 110 in the stage where outputting of an image signal for image formation becomes ready. Upon receipt of the instructions, the control unit 200 sends a TOP signal, which is a sub scanning synchronization signal, and a BD signal, which is a main scanning synchronization signal, to the image signal generation unit 100 as soon as printing becomes ready. The image signal generation unit 100 having received the above-described two kinds of synchronization signal outputs the above-described VDO signal to the laser drive unit 300 at predetermined timing.

Figure 6:
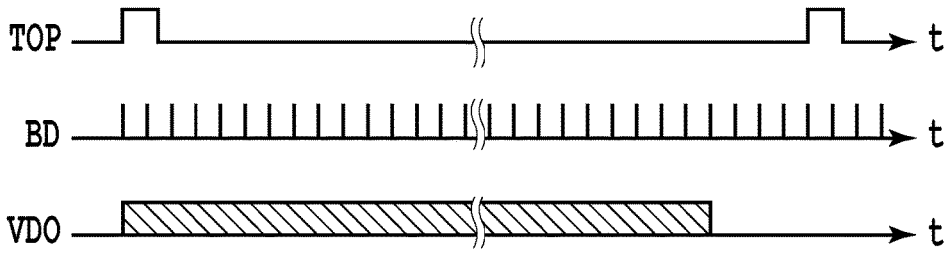
FIG. 6 is timing charts of synchronization signals and an image signal in the case where an operation to form an image corresponding to one page of a printing medium is performed.

FIG. 6 is timing charts of the above-described two kinds of synchronization signal and the image signal in the case where the operation to form an image corresponding to one page of a printing medium is performed. In FIG. 6, time elapses from left toward right. In response to the arrival of the front end of a sheet (printing medium) at the detection position of a registration sensor (not shown) provided between a paper feed unit 900 and the conveyance roller 600, the TOP signal, which is an output of the registration sensor 1000, switches to "HIGH". The image signal generation unit 100 outputs the VDO signal in synchronization with the BD signal immediately after the reception of "HIGH" of the TOP signal. Based on the VDO signal, the light source 401 emits light and thus a latent image is formed on the photoconductor drum 500.

In FIG. 6, for the sake of simplification, the VDO signal is shown so as to be output continuously, spanning a plurality of BD signals. However, in fact, the VDO signal is output during a predetermined period of time between the BD signal being output and the next BD signal being output. Details will be described later.

<Correction of Partial Magnification>

Figure 7:
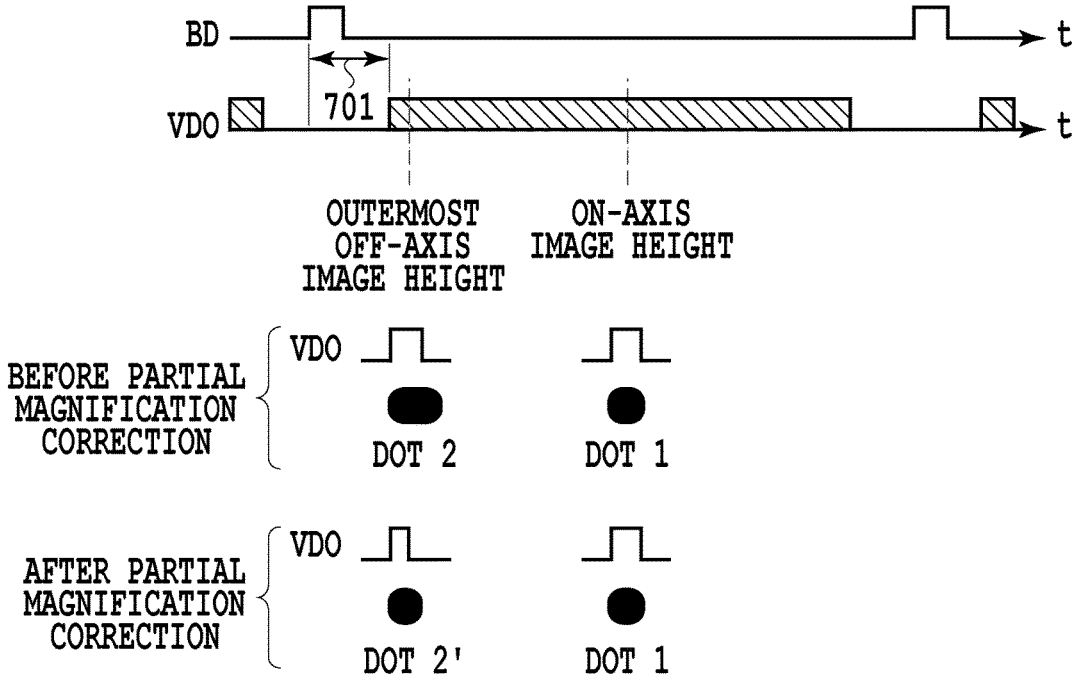
FIG. 7 is a diagram showing timing of a BD signal and a VDO signal and dot images formed from a latent image on a surface to be scanned.

Next, the correction method of the partial magnification in the main scanning direction is explained. Before explanation, the factor of the partial magnification and the correction principle are explained. FIG. 7 is a diagram showing timing of the BD signal and the VDO signal in one scanning period of laser beam, and dot images formed from a latent image on the surface to be scanned 407. One scanning period of laser beam is a period of time between a BD signal being generated and the next BD signal being generated.

The image signal generation unit 100 controls the output timing of the VDO signal to the laser drive unit 300 by taking the rise edge of the received BD signal as a reference. By controlling the output timing of the VDO signal by taking the BD signal as a reference, it is possible to set the start position of latent image formation at a position a predetermined distance apart from the end of the photoconductor drum 500 on the upstream side in the scanning direction of laser beam. An adjustment amount (scanning position adjustment amount) specifying timing to start scanning on the photoconductor drum 500 from the set start position of latent image formation is indicated by a bidirectional arrow 701. The adjustment of the start position of latent image formation in the main scanning direction is made by a scanning position adjustment amount derivation program, to be described later. Then, by the laser drive unit 300 supplying a drive current to the light source 401 based on the VDO signal, the light source 401 emits light and a latent image in accordance with the VDO signal is formed on the surface to be scanned 407.

In the following, the case is explained where the light source 401 is caused to emit light during the same period of time at the on-axis image height and the outermost off-axis image height based on the VDO signal. Here, the size of a dot corresponds to one dot of 600 dpi (42.3 μm in the main scanning direction). As described above, the optical scanning device 400 has an optical configuration with the characteristics that the scanning speed at the end (outermost off-axis image height) is high compared to that at the center (on-axis image height) on the surface to be scanned 407. In FIG. 7, before the correction, the latent image (dot 2) at the outermost off-axis image height bulges out in the main scanning direction compared to the latent image (dot 1) at the on-axis image height. Consequently, in the present embodiment, as the partial magnification correction, the period and the time width of the VDO signal are corrected in accordance with the position in the main scanning direction. That is, the light emission time interval at the outermost off-axis image height is made shorter than the light emission time interval at the on-axis image height and the dot size at the outermost off-axis image height is made smaller than the dot 2 before the correction to obtain a latent image such as the latent image (dot 2'), and thereby, the size is corrected to the same size of the latent image (dot 1) at the on-axis image height. By performing the correction (partial magnification correction) such as this in accordance with the plurality of exposure positions of laser beam in the main scanning direction, it is possible to control the unevenness in the dot width with respect to the main scanning direction.

Figure 8:
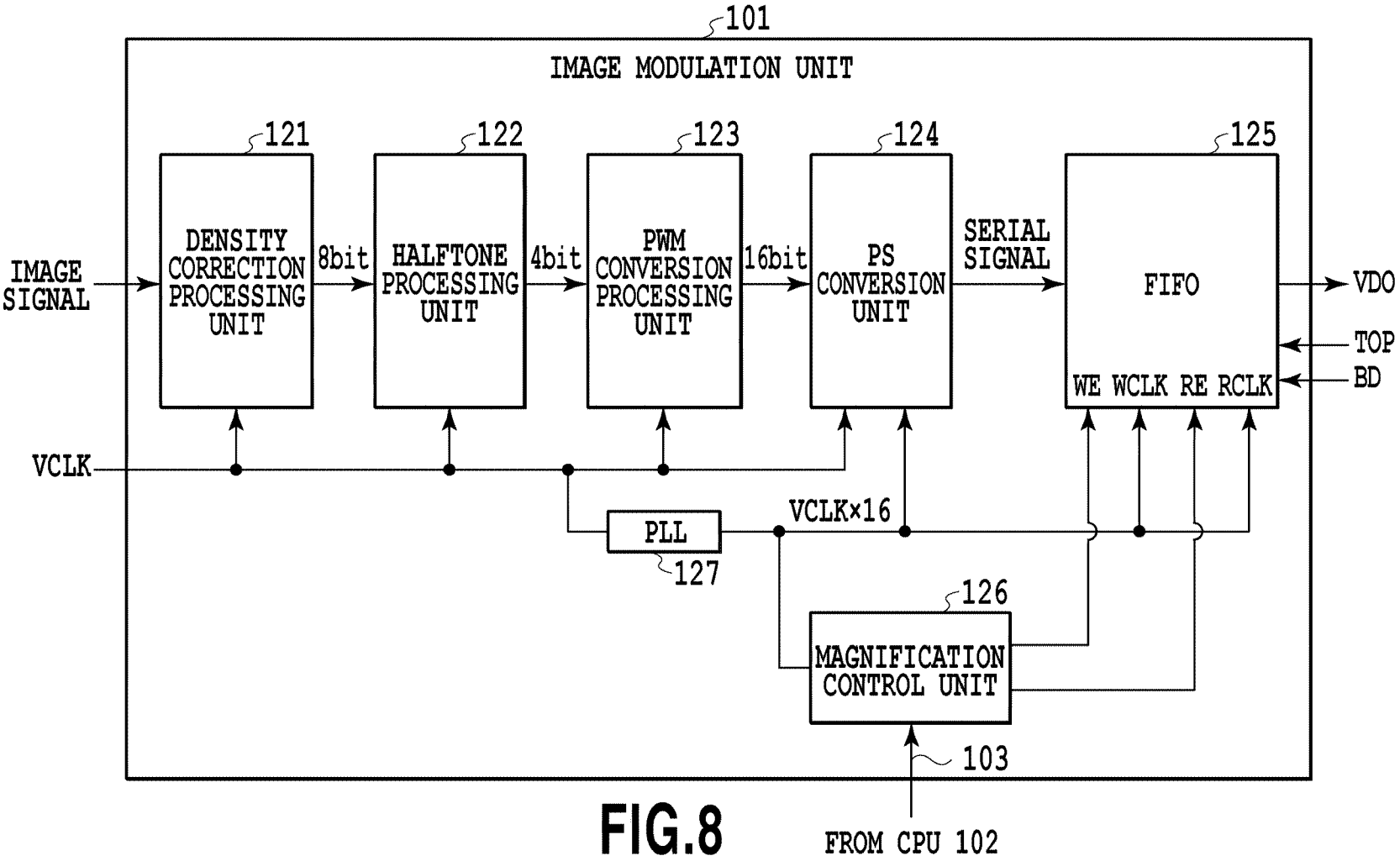
FIG. 8 is a block diagram showing an internal configuration of an image modulation unit.

Next, the control to shorten the irradiation time of the light source 401 by an amount corresponding to the increase in the partial magnification at each position as the image height makes a transition from the on-axis image height into the off-axis image height is explained. FIG. 8 is a block diagram showing an internal configuration of the image modulation unit 101.

A PLL unit 127 of the present embodiment generates a multiple clock (VCLK×16) obtained by multiplying the frequency of a reference clock (VCLK) corresponding to one pixel by 16. VCLK is input to a density correction processing unit 121, a halftone processing unit 122, a PWM conversion processing unit 123, and a PS conversion unit 124. VCLK×16 is input to the PS conversion unit 124, a FIFO 125, and a magnification control unit 126.

The density correction processing unit 121 performs density correction processing for printing an image signal received from a host computer (not shown) in synchronization with VCLK at an appropriate density. Further, the density correction processing unit 121 stores a density correction table for this. Then, the density correction processing unit 121 parallelly outputs an 8-bit image signal for which the density correction processing has been performed in synchronization with VCLK. The 8-bit image signal is input to the halftone processing unit 122.

The halftone processing unit 122 performs processing to convert the 8-bit image signal input in synchronization with VCLK into an image signal (here, a multivalued parallel 4-bit image signal) the density of which can be represented by the image forming apparatus by performing halftone processing, such as the dither method, for the 8-bit image signal. Then, the halftone processing unit 122 parallelly outputs the 4-bit image signal for which the halftone processing has been performed in synchronization with VCLK. The 4-bit image signal is input to the PWM conversion processing unit 123.

The PWM conversion processing unit 123 converts the multivalued parallel 4-bit image signal after the halftone processing that is input in synchronization with VCLK into a bit pattern including a plurality of pieces of bit data. The PWM conversion processing unit 123 stores a PWM conversion table for conversion processing in an internal register. The PWM conversion processing unit 123 converts the 4-bit image signal into a plurality of pieces of bit data for turning ON/OFF the light source 401 by performing PWM conversion processing. The PWM conversion processing unit 123 of the present embodiment converts the image signal one pixel of which is represented by 4 bits into 16-bit bit data. Of course, it may also be possible to set a PWM conversion table with which the PWM conversion processing unit 123 converts the image signal one pixel of which is represented by 4 bits into 32-bit bit data or bit data with another number of bits. The PWM conversion processing unit 123 parallelly outputs the converted bit pattern to the PS conversion unit 124 in synchronization with VCLK.

Figure 9A:
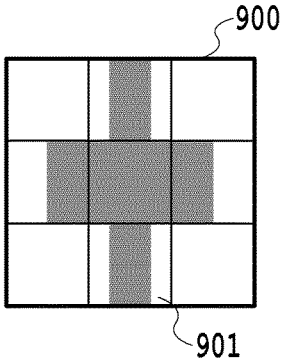
FIG. 9A and FIG. 9B are diagrams explaining screen processing, FIG. 9A showing the way density is represented by the area within a matrix to be filled in gray, and FIG. 9B showing the way one pixel is represented by 16-bit bit data.
Figure 9B:
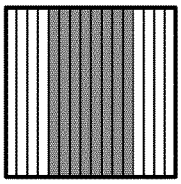

FIG. 9A and FIG. 9B are diagrams explaining screen processing. In the example in FIG. 9A, the density is represented by the area to be filled in gray within a matrix 900 consisting of three pixels in the main scanning direction and three pixels in the sub scanning direction. One of the pixels constituting the matrix 900 is the unit with which the image data is demarcated in order to form one dot of 600 dpi on the surface to be scanned 407. By the screen processing, each pixel has a value (half dot) representing a halftone density. FIG. 9B is a diagram of an enlarged pixel 901, showing that one pixel is represented by 16-bit bit data. By the 16-bit bit data, the light emission of the light source 401 is switched between ON and OFF. That is, by representing one pixel by 16-bit bit data, one pixel is represented at 16 tone levels as a result. In FIG. 9B, the area in which light emission is turned ON is represented in gray and the area in which light emission is turned OFF in white. In the case of the pixel 901 shown in FIG. 9B, light emission is turned ON for the width corresponding to 8/16 of the width of one pixel. Explanation is returned to FIG. 8.

The PS conversion unit 124 is a parallel/serial conversion unit. The PS conversion unit 124 serially outputs the 16-bit bit data input parallelly from the PWM conversion processing unit 123 in synchronization with VCLK by one bit each time in order in synchronization with VCLK×16.

The FIFO 125 serially receives the bit data from the PS conversion unit 124 in synchronization with VCLK×16 and accumulates the bit data in a line buffer (not shown). Then, the FIFO 125 outputs the accumulated bit data to the laser drive unit 300 in the subsequent stage by one bit each time in synchronization with VCLK×16 after a predetermined time elapses. As a reference of measurement of the predetermined time, the TOP signal and the BD signals are used. Due to this, the FIFO 125 plays a role as the scanning position adjustment unit described previously. Further, the magnification control unit 126 outputs a write enable signal WE and a read enable signal RE to the FIFO 125 based on partial magnification characteristic information received from the CPU 102 via the CPU bus 103. The FIFO 125 controls write and read of the input bit data based on the write enable signal WE and the read enable signal RE.

Figure 10A:
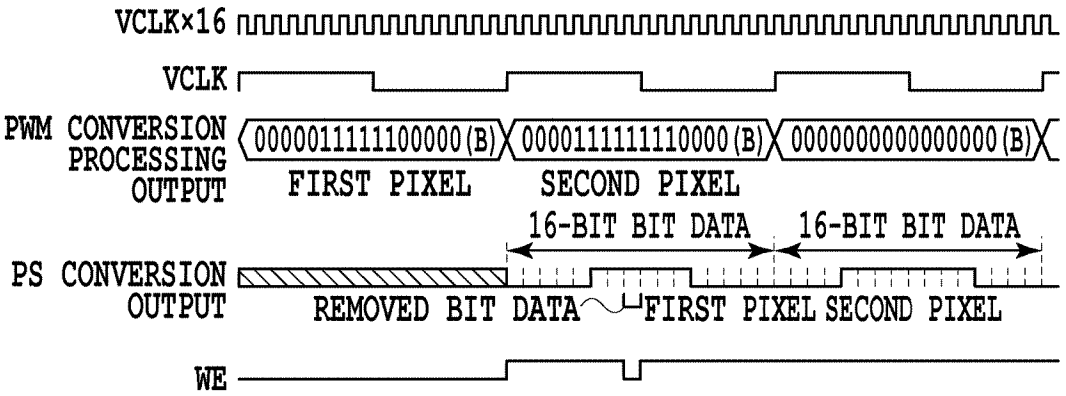
FIG. 10A and FIG. 10B are time charts relating to the operation after halftone processing, FIG. 10A showing the case where bit data is deleted, and FIG. 10B showing the case where bit data is inserted.
Figure 10B:
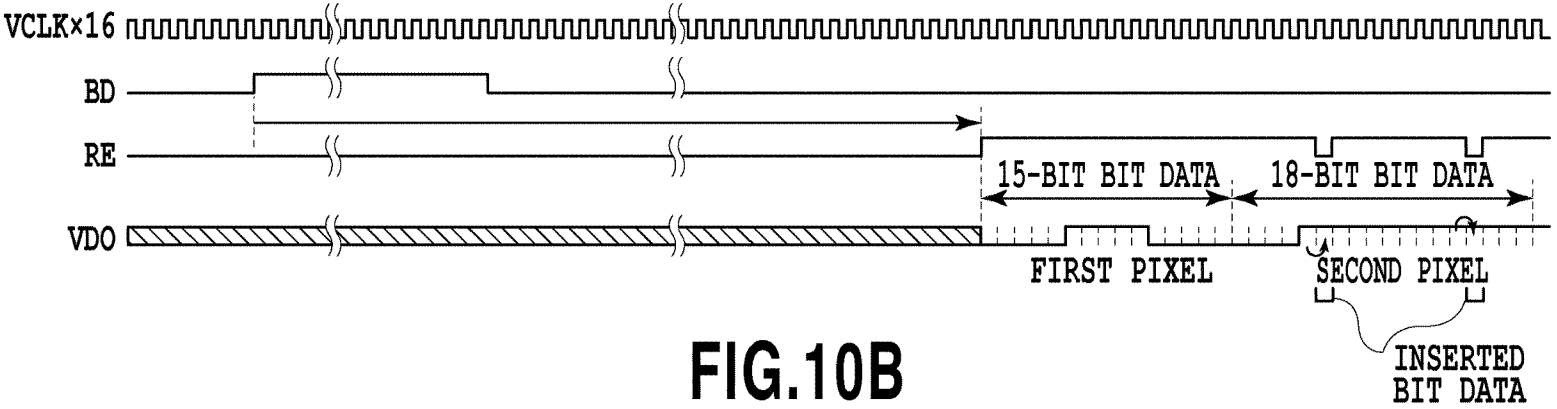

Next, the operation after the halftone processing in the image modulation unit 101 is explained. FIG. 10A and FIG. 10B are time charts relating to the operation after the halftone processing. FIG. 10A corresponds to the case where the image modulation unit 101 deletes bit data from the bit pattern generated by the PWM conversion processing unit 123 and FIG. 10B corresponds to the case where the image modulation unit 101 inserts bit data into the bit pattern generated by the PWM conversion processing unit 123, respectively.

First, the operation in the case where the image modulation unit 101 deletes bit data from the bit pattern is explained. As described above, in FIG. 10A, the PS conversion unit 124 takes in the 16-bit bit pattern from the PWM conversion processing unit 123 in synchronization with the rise edge of the clock (VCLK). Then, the PS conversion unit 124 serially transmits the bit data to the FIFO 125 in synchronization with VCLK×16.

The magnification control unit 126 outputs the write enable signal WE based on the partial magnification characteristic information from the CPU 102. Because VCLK×16 is input to the magnification control unit 126, it is possible for the magnification control unit 126 to switch the outputs of the write enable signal WE at the frequency of VCLK×16.

The FIFO 125 takes in bit data from the PS conversion unit 124 only in the case where the WE signal that the magnification control unit 126 outputs is "HIGH (valid)". In the case where reduction correction of an image formed by the bit pattern that is input to the FIFO 125 is performed, the magnification control unit 126 turns the WE signal to "LOW (invalid)". In the case where the WE signal is "LOW (invalid)", the FIFO 125 does not take in bit data, and therefore, no bit data is input to the FIFO 125 from the PS conversion unit 124. That is, in the case where the magnification control unit 126 turns the WE signal to "LOW (invalid)" during the period of time corresponding to one period of VCLK×16, the bit data that the PS conversion unit 124 tries to input to the FIFO 125 is not input to the FIFO 125 during the period of time during which the WE signal is "LOW (invalid)". Then, in the next period of VCLK×16, the WE signal turns to "HIGH (valid)", and therefore, the bit data next to the bit data that the PS conversion unit 124 tries to input to the FIFO 125 during the period of time during which the WE signal is "LOW (invalid)" is input to the FIFO 125 from the PS conversion unit 124. It is possible for the magnification control unit 126 to switch the outputs of the WE signal in the period of VCLK×16. Consequently, by the magnification control unit 126 switching the outputs of the WE signal in the period of VCLK×16, it is possible to reduce the image width with a resolution of the product of the period of VCLK×16 and the scanning speed of laser beam.

Subsequently, the operation in the case where the image modulation unit 101 inserts bit data into the bit pattern is explained. The magnification control unit 126 outputs the read enable signal RE based on the partial magnification characteristic information from the CPU 102. Because VCLK×16 is input to the magnification control unit 126, it is possible for the magnification control unit 126 to switch the outputs of the read enable signal RE at the frequency of VCLK×16.

As described above, in FIG. 10B, it is possible for the FIFO 125 to read the accumulated bit data in synchronization with VCLK×16 only in the case where the RE signal is "HIGH". The signal that the FIFO 125 outputs by one bit each time in synchronization with VCLK×16 is the VDO signal. At this time, the image modulation unit 101 performs control to detect the rise timing of the TOP signal with respect to the sub scanning direction, to count the number of BD signals from the timing, and to start outputting of bit data from the line that reaches a desired count number. Further, the image modulation unit 101 performs control to detect the rise timing of the BD signal with respect to the main scanning direction, to count the number of cycles of VCLK×16 from the timing, and to start outputting of bit data from the position that reaches a predetermined count number. By controlling the output start timing of bit data after counting the number of cycles as described above, adjustment is made so that image formation is performed from the specified position in the main scanning direction (position of the specified count number). The width at this time is the scanning position adjustment amount indicated by the bidirectional arrow 701 in FIG. 7 described previously. The specified position at this time is specified so that the center position of the latent image to be formed on the photoconductor 500 aligns with the center position of the printing medium onto which a toner image corresponding to the latent image is transferred. In the present embodiment, the scanning position adjustment amount 701 is found by the information processing apparatus that executes a scanning position adjustment amount derivation program, to be described later, and is set to the image forming apparatus. In the case where enlargement correction of an image formed by the bit pattern that is input to the FIFO 125 is performed, the magnification control unit 126 switches the RE signal to "LOW". In the state where the RE signal of "LOW" is input to the FIFO 125, the FIFO 125 does not update the bit data to be read even in the case where the rise edge of VCLK×16 is input and continues to output the bit data that was output at the previous rise edge of VCLK×16. That is, as long as the RE signal of "LOW" is input to the FIFO 125, the FIFO 125 continues to output the bit data that was output at the time of the RE signal of "LOW" being input. It is possible for the magnification control unit 126 to switch the outputs of the RE signal in the period of VCLK×16. By the magnification control unit 126 switching the outputs of the RE signal in the period of VCLK×16, it is possible to increase the number of pieces of bit data output from the FIFO 125 in the period of VCLK×16. Consequently, by the magnification control unit 126 switching the outputs of the WE signal in the period of VCLK×16, it is possible to reduce the image width with a resolution of the product of the period of VCLK×16 and the scanning speed of laser beam. FIG. 10B shows the example in which in the case where one pixel is represented by 16-bit bit data, one bit of bit data is deleted from the first pixel so that the first pixel consists of 15-bit bit data and two bits of bit data are inserted to the second pixel so that the second pixel is represented by 18-bit bit data. The FIFO 125 used in the present embodiment is explained as a circuit having a configuration in which the previous output is continued in the case where the RE signal is turned to "LOW" in place of a configuration in which the output enters the Hi-Z (high impedance) state.

Figure 11A:
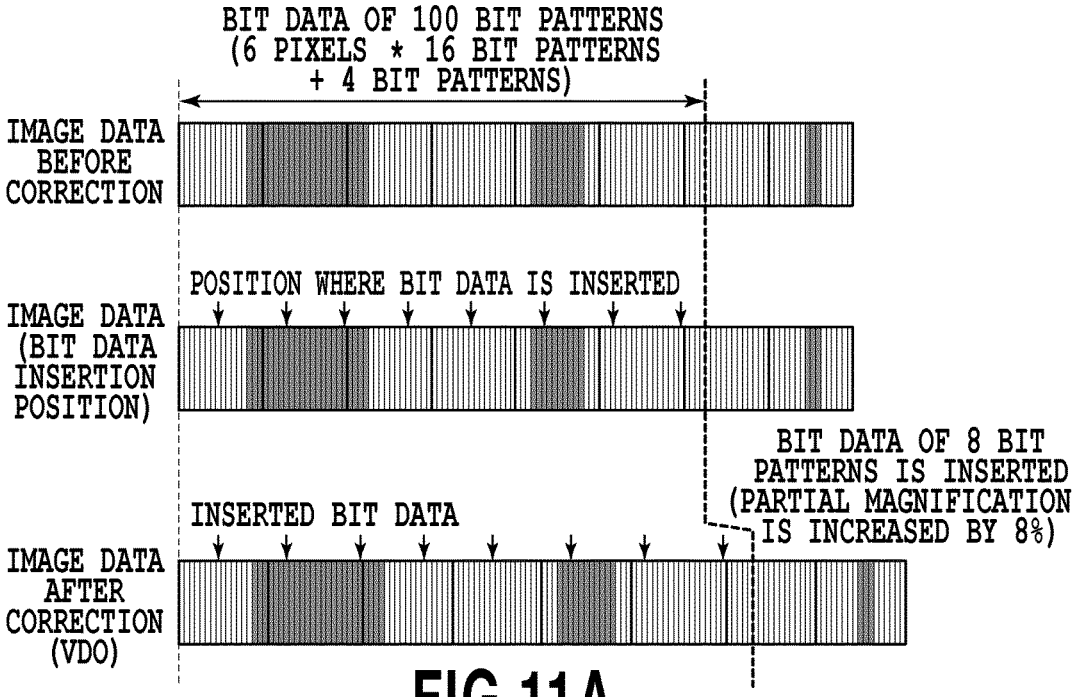
FIG. 11A and FIG. 11B are diagrams explaining the way bit data is removed or inserted for a serial signal that is output from a PS conversion unit, FIG. 11A showing an example in which bit data is inserted to lengthen an image and FIG. 11B showing an example in which bit data is removed to shorten an image.
Figure 11B:
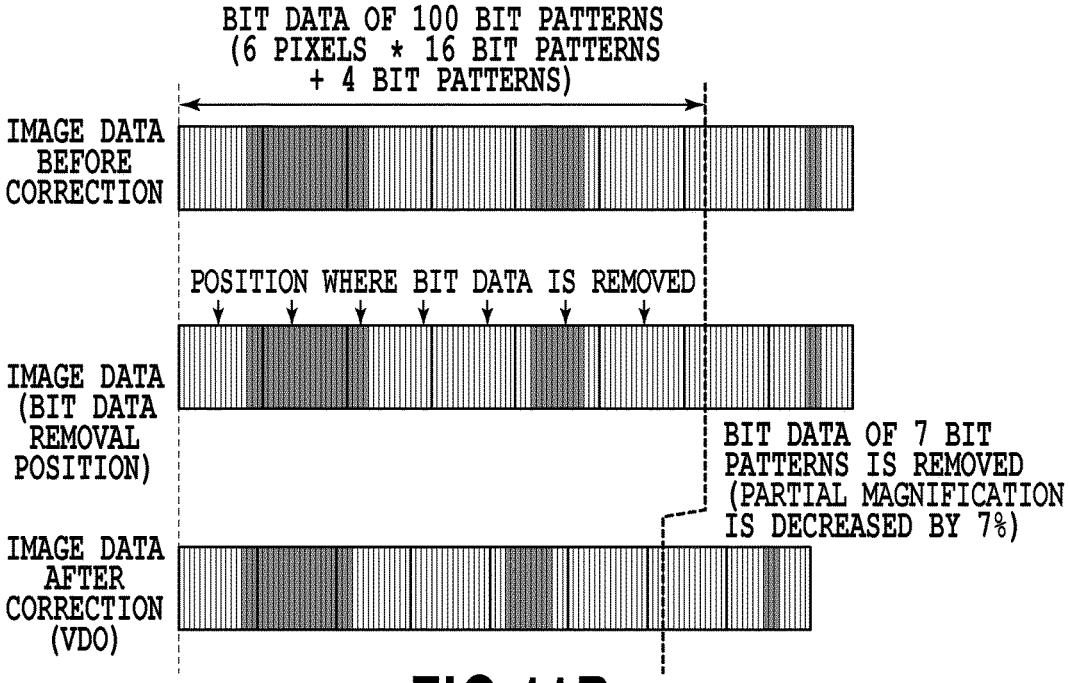

FIG. 11A and FIG. 11B are diagrams explaining the way correction is performed for the bit data output from the PS conversion unit 124, FIG. 11A showing an example of correction to increase the magnification of an image by inserting bit data into the bit pattern and FIG. 11B showing an example of correction to decrease the magnification of an image by deleting bit data from the bit pattern. FIG. 11A shows the example in which the partial magnification is increased by 8%. It is possible to increase the partial magnification by 8% by inserting a bit pattern corresponding to eight bits in total at regular or substantially regular intervals into the 100 continuous bit patterns. FIG. 11B shows the example in which the partial magnification is decreased by 7%. It is possible to decrease the partial magnification by 7% by deleting bit data corresponding to seven bits in total at regular or substantially regular intervals from the 100 continuous bit patterns. As described above, in the partial magnification correction, it is possible to make the width of an image substantially equal regardless of the exposure position of laser beam with respect to the main scanning direction by inserting bit data into the bit pattern or deleting bit data from the bit pattern in accordance with the exposure position of laser beam in the main scanning direction. That the width of an image is substantially equal with respect to the main scanning direction means that there may be a slight variation in the width of an image as the results of performing the partial magnification correction and that the width of an image does not need to be perfectly equal.

As already described, the scanning speed increases as the absolute value of the image height Y becomes greater. Because of this, in the partial magnification correction, bit data is inserted or deleted so that the image becomes shorter as the absolute value of the image height Y becomes greater (so that the length of one pixel becomes shorter). What is important here is that bit data is inserted or deleted so that the size of one dot (one pixel) of the image data before the correction becomes the same on the surface to be scanned 407.

<Luminance Correction>

Next, luminance correction is explained. The reason the luminance correction is performed is that the length of one pixel is changed due to the partial magnification correction and the total exposure amount (integrated light amount) per pixel by the light source 401 does not become fixed. Consequently, by correcting the luminance of the light source 401 in accordance with the main scanning position, the total exposure amount (integrated light amount) per pixel is adjusted so as to become fixed at each main scanning position.

With reference to FIG. 5 described previously, details of the luminance correction in the present embodiment are explained. The control unit 200 has an IC (not shown) incorporating a regulator or the like and constitutes a luminance correction unit together with the laser drive unit 300. The IC inside the control unit 200 outputs a luminance correction analog voltage that increases or decreases within the main scanning in synchronization with the BD signal to the laser drive unit 300. The laser drive unit 300 has a memory 301 and a laser driver IC (not shown) and supplies a drive current to the light-emitting unit (not shown) of the light source 401 by making use of the input luminance correction analog voltage. Here, in the memory 301, information about a correction current to be supplied to the light-emitting unit is saved as well as a scanning speed profile, to be described later, and the partial magnification characteristic information are saved. The partial magnification characteristic information is information in which the partial magnification corresponding to a plurality of image heights for the main scanning direction is described. The CPU (not shown) of the IC inside the control unit 200 reads the information stored in the memory 301 via serial communication 111 and sends out the information to the CPU 102 of the image signal generation unit 100 via the serial communication 110.

As described above, by the control unit 200 increasing or decreasing the luminance correction analog voltage in accordance with the main scanning position based on the information about the correction current within the memory 301 and by the laser drive unit 300 performing control so that the drive current to the light-emitting unit of the light source 401 becomes fixed at each main scanning position, the luminance correction is implemented.

<Derivation of Scanning Position Adjustment Amount>

Figure 12:
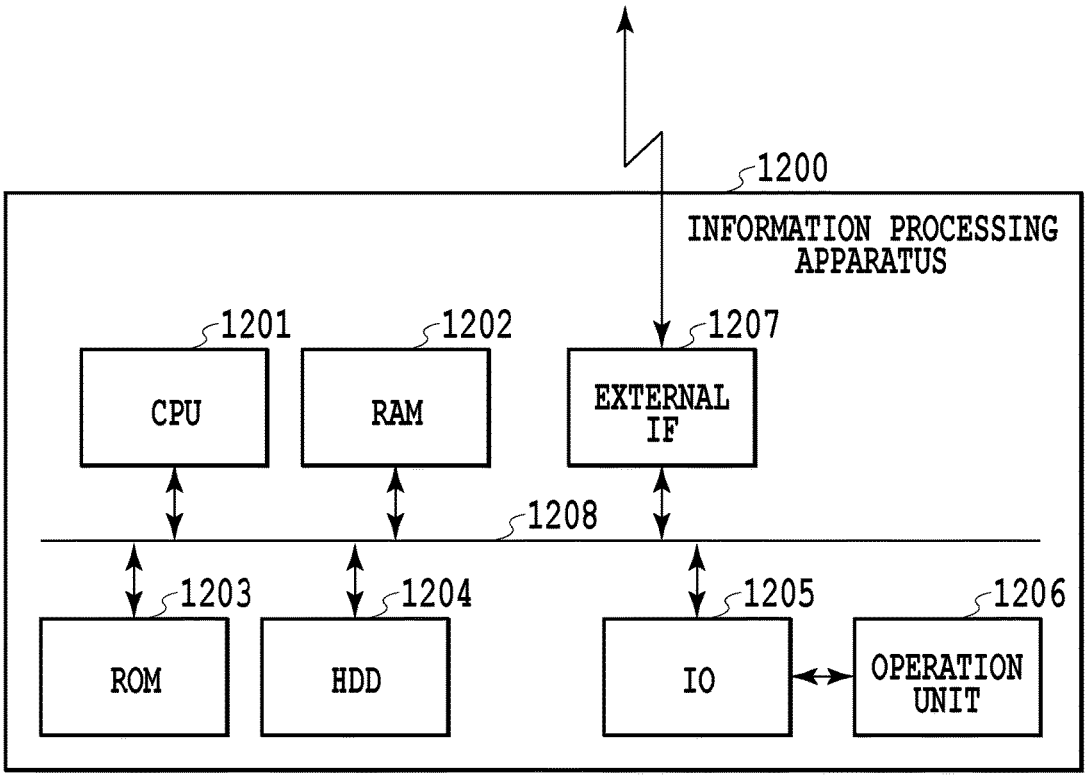
FIG. 12 is a diagram showing a hardware configuration example of an information processing apparatus that derives a scanning position adjustment amount.

Subsequently, derivation of the scanning position adjustment amount is explained. FIG. 12 is a diagram showing a hardware configuration example of an information processing apparatus that derives the scanning position adjustment amount. An information processing apparatus 1200 includes a CPU 1201, a RAM 1202, a ROM 1203, an HDD 1204, an IO unit 1205, an operation unit 1206, and an external I/F 1207 and these are connected to one another via a bus 1208.

The CPU 1201 provides various functions by reading programs, such as an OS (Operating System) and application software, from the HDD 1204 and executing them. Further, the CPU 1201 centralizedly controls scanning position adjustment amount derivation processing, to be described later. The RAM 1202 is a system work memory in the case where the CPU 1201 executes a program. The ROM 1203 stores programs to activate BIOS (Basic Input Output System) and OS, and setting files. The HDD 1204 is a hard disk drive and stores system software and a scanning position adjustment amount derivation program, to be described later. The external I/F 1207 is connected to a LAN or USB cable and performs communication (transmission and reception of data and the scanning position adjustment amount) with an external device, such as the image forming apparatus. The IO unit 1205 is an interface that inputs information to and outputs information from the operation unit 1206 including input/output devices (not shown), such as a display and a mouse. On the display, predetermined information is drawn with a predetermined resolution and a predetermined number of colors based on screen information specified by a program. For example, a GUI (Graphical User Interface) screen is formed and various windows, data, etc., necessary for the operation are displayed thereon.

Figure 13:
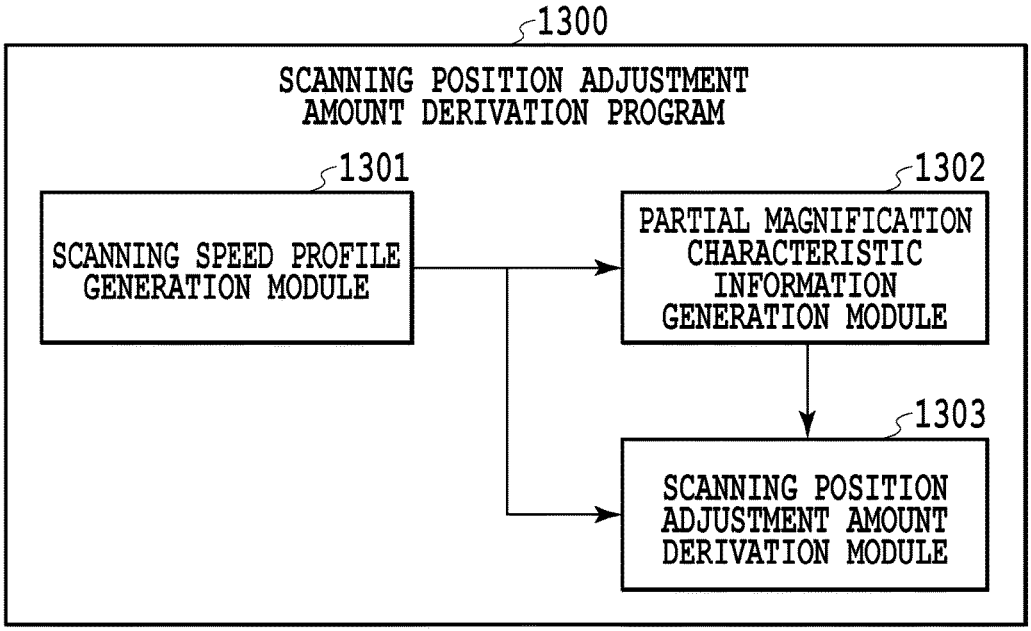
FIG. 13 is a function block diagram showing an internal configuration of a program that implements scanning position adjustment amount derivation processing.

FIG. 13 is a function block diagram showing an internal configuration of the scanning position adjustment amount derivation program. This program is stored within the HDD 1204 and the scanning position adjustment amount derivation processing is implemented by the CPU 1201 executing a boot program to read this program onto the RAM 1202 from the HDD 1204 and executing the program.

A scanning position adjustment amount derivation program 1300 includes a scanning speed profile generation module 1301, a partial magnification characteristic information generation module 1302, and a scanning position adjustment amount derivation module 1303.

First, the scanning speed profile generation module 1301 is explained. The scanning speed profile is a profile indicating a relationship between the scanning position and the partial magnification as shown in FIG. 3 described previously. The scanning speed profile is basically expressed by expression (3) described previously and is found from the optical characteristics, such as the image formation coefficient K and the scanning characteristics coefficient B. Consequently, it is possible to generate the scanning speed profile by inputting the information about the optical characteristics of the optical scanning device 400 used in the image forming apparatus from the operation unit 1206 and by using expression (3) described previously.

It may also be possible to find the scanning speed profile from a test pattern image actually formed by the optical scanning device 400 in order to take into consideration the individual difference at the time of manufacturing of each lens and the assembling error of each part, such as the lens. In this case, first, a predetermined pattern image is output onto a printing medium by using the optical scanning device 400. This pattern image is, for example, an image in which dots are arranged at fixed intervals in the main scanning direction. In the case where the pattern image such as this is output onto a printing medium without performing the partial magnification correction processing described previously, the dot width changes in accordance with the main scanning position due to the difference in the scanning speed. Specifically, the width of the dot becomes greater as the main scanning end is approached (see FIG. 7). It is possible to estimate the scanning speed from the change in the dot width. Then, the output pattern image is read by a scanner or the like and input to the information processing apparatus 1200 via the external I/F 1207. The information processing apparatus 1200 reads the amount of change in the dot width up to the main scanning end (outermost off-axis image height) by taking the dot width at the main scanning center (on-axis image height) as a reference, and generates the scanning speed profile from the read results. The amount of increase or decrease in the dot width at each main scanning position with respect to the dot width at the main scanning center (on-axis image height) corresponds to the amount of increase or decrease in the partial magnification (amount of change in speed).

FIG. 14 is a diagram showing an example of the generated scanning speed profile. In the example in FIG. 14, the scanning speed profile is held in the form of an LUT (lookup table). Address in the LUT indicates the main scanning position and Data in the LUT indicates the partial magnification at each position (each address) in the case where the partial magnification at the main scanning center (on-axis image height) is taken to be 100%. Here, one dot of 600 dpi is taken to be one pixel and the main scanning width (W in FIG. 2A) is taken to be 8,192 pixels.

Next, the partial magnification characteristic information generation module 1302 is explained. The partial magnification characteristic information generation module 1302 generates information indicating at which position in the main scanning direction the magnification correction of the image is necessary by the magnification control unit 126 described previously from the scanning speed profile. The partial magnification characteristic information generation module 1302 refers to the partial magnification at each main scanning position and converts the magnification correction amount at each main scanning position into the number of pieces of bit data to be inserted or the number of pieces of bit data to be deleted. However, in the present embodiment, one pixel is represented by 16-bit bit data, and therefore, in the case where the partial magnification is converted into the number of pieces of bit data in terms of the number of pieces of bit data corresponding to the 1/16 pixel, the error accumulates for each pixel and becomes a large error finally. Consequently, as in the examples in FIG. 11A and FIG. 11B described previously, the main scanning is demarcated at predetermined intervals (e.g., 100 pixels), an average partial magnification is calculated for each predetermined interval, and the calculated average partial magnification is applied at regular or substantially regular intervals. For example, in the case where an increase in the average partial magnification is 8% for the bit pattern in which 100-bit bit data is continuous, the insertion position and the interval of the bit data are determined so that eight pieces of bit data in total are inserted at regular intervals into the bit pattern.

Next, the scanning position adjustment amount derivation module 1303 is explained. In the image forming apparatus having an optical scanning device in which the scanning speed is fixed, the scanning position adjustment amount is determined by the width in the main scanning position of an image desired to be formed, the distance interval between the BD sensor and the photoconductor drum, the angular speed of the deflector (polygon mirror), etc. However, in the image forming apparatus as in the present embodiment, in which the scanning speed is not fixed (because of this, the partial magnification correction is performed), it becomes necessary to take the scanning speed profile into consideration.

As already explained, the on-axis image height means the center of the photoconductor drum 500 and indicates the main scanning center position of a printing medium. Consequently, a printing medium is fed from the paper feed unit 900 so that the position of the on-axis image height (center of the photoconductor drum) becomes the center of the main scanning and a toner image corresponding to a latent image formed on the photoconductor drum 500 is transferred onto the printing medium. That is, it becomes necessary to set the scanning position adjustment amount so that the center of the photoconductor drum becomes the center position of a latent image (toner image) regardless of the size of the printing medium. At this time, the distance from the center of the drum to the printing medium end in the main scanning direction is determined by the size of the printing medium. Next, it is possible to find the scanning speed by expression (2) described previously. It is possible to easily find the speed at each main scanning position by finding the speed $dY/d\theta=K$ at each on-axis image height from expression (2) in advance and by multiplying this by the magnification for each position in the scanning speed profile (see FIG. 14) described above.

Figure 15:
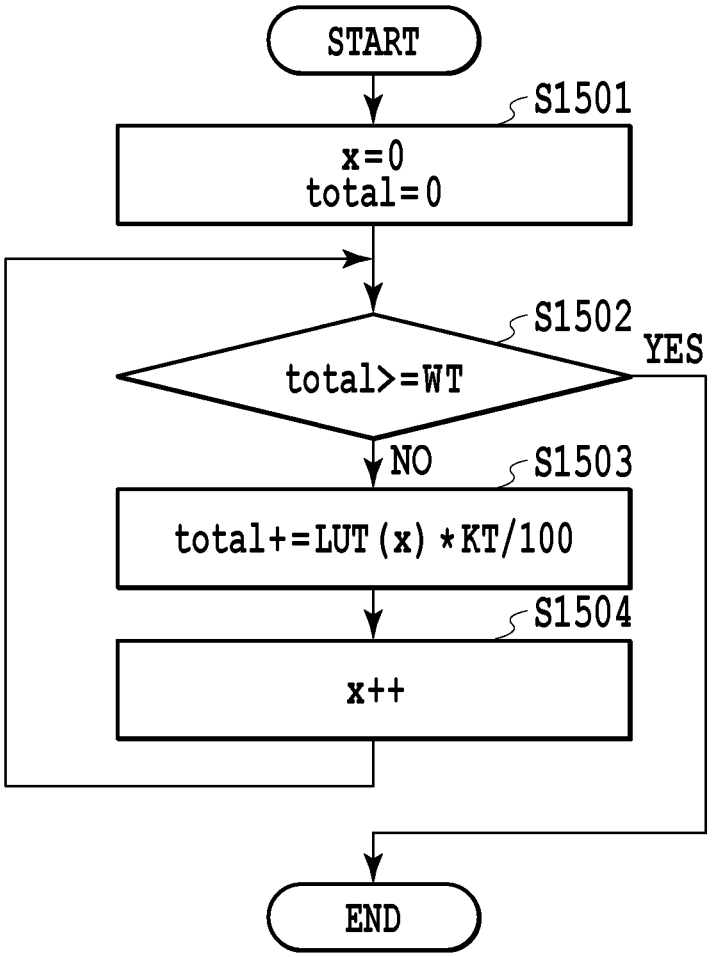
FIG. 15 is a flowchart showing a flow of the scanning position adjustment amount derivation processing.

FIG. 15 is a flowchart showing a flow of the scanning position adjustment amount derivation processing according to the present embodiment. The scanning position adjustment amount derived by this flow is represented by the number of cycles of the clock the frequency of which has been multiplied (VCLK×16) from the rise edge timing of the BD signal corresponding to the reference position described above to the printing medium end.

At step 1501, various variables are initialized. Here, a variable x represents a target pixel position and x=0 represents the rise timing of the BD signal. The value of the target pixel position x is added to the previous value as this flows progresses and the value of the variable x at the time of the end of this flow is the scanning position adjustment amount to be found. Further, a variable total represents the distance from the position corresponding to the rise timing of the BD signal to the current target pixel position and the initial value is 0.

Figure 16:
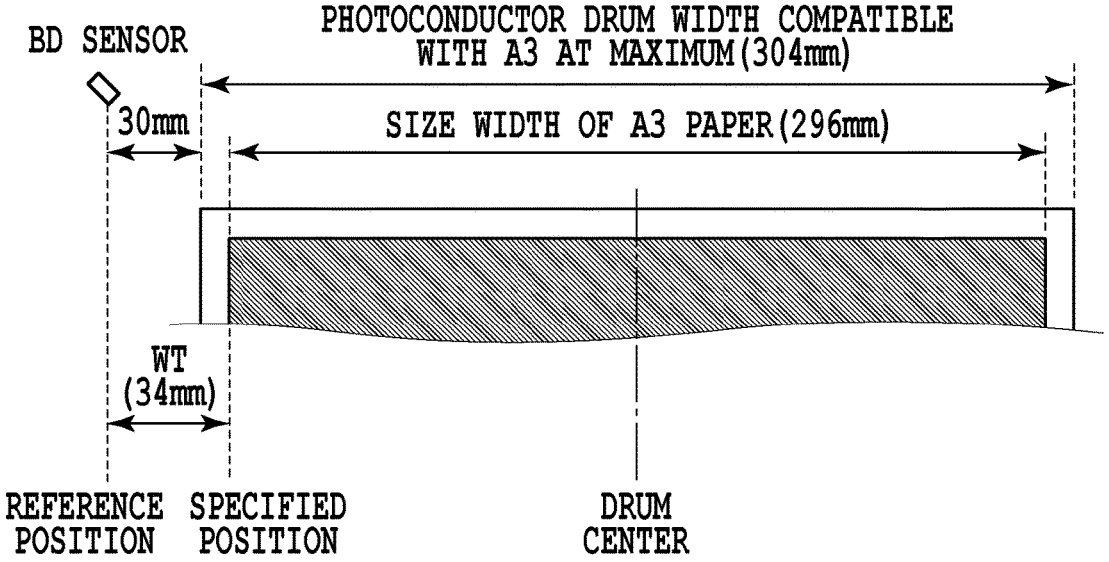
FIG. 16 is a diagram showing a constant WT in the case where the size of a printing medium is A3.

At step 1502, whether or not the value of the variable total is greater than or equal to a constant WT is determined. Here, the constant WT is a value representing the distance from the DB sensor position, which is the reference position, to the printing medium end where formation of a latent image should be started, representing the scanning position adjustment amount in terms of distance. It is possible to find the variable WT by measuring the distance from the BD sensor position to the photoconductor drum center in advance and by subtracting a length that is determined for each size of the printing medium from the distance. The length determined for each size of the printing medium is the distance from the photoconductor drum center to the printing medium end, and in the case where the printing medium center and the photoconductor drum center coincide with each other, the length is half the length of the printing medium in the main scanning direction. FIG. 16 shows the constant WT in the case where the size of the printing medium is A3. In FIG. 16, the distance from the DB sensor position to the photoconductor drum center is 30 mm+(304 mm/2)=182 mm. Then, the length determined for each size of the printing medium is 296 mm/2=148 mm. Consequently, the constant WT in this case is 182 mm−148 mm=34 mm. In the case where the results of the determination indicate that the value of the variable total is less than the value of the constant WT, the processing proceeds to step 1503. On the other hand, in the case where the value of the variable total has reached the value of the constant WT, this processing is terminated. That the value of the variable total has reached the value of the constant WT means that the value of the variable total representing the accumulated value of the distance up to the current target pixel position x has reached the printing medium end where formation of a latent image should be started.

At step 1503, the value of the variable total is updated. Specifically, LUT (x)×K×T/100 is found and the value that is found is taken to be a new value of the variable total. Here, LUT (x) is the data value of the LUT at the current target pixel position x (value of the partial magnification in the LUT as the scanning speed profile). In the case of the LUT shown in FIG. 14, for example, on a condition that x=0, the value of the LUT (x) is 138. The constant K represents the scanning speed at the on-axis image height (drum center). Here, in the case where one pixel (one dot of 600 dpi) is scanned in one cycle of VCLK at the on-axis image height, one pixel=25.4 mm/600=0.042 mm, and therefore, the constant K is 0.042 mm/0.05 μs=0.84 mm/μs. Then, a constant T represents the period of VCLK and in the case where the frequency of VCLK is 20 MHz, the period T is 0.05 μs. As described above, "LUT (x)×K×T/100" represents the "distance to be scanned of the target pixel position x per period of VCLK" and the value thus found is added to the value of variable total.

At step 1504, the value of the target pixel position x is incremented (+1) and updated. After the value of the target pixel position x is updated, the processing returns to step 1502 and the processing is continued.

In this manner, the processing to add the value of the variable total while shifting the target pixel position is performed until the value of the variable total reaches the constant WT. For example, in the case where x=0, from the above-described condition, total=138/100*0.84*0.05=0.058 mm. Consequently, it is known that the position in the case where x=1 is the position having advanced 0.058 mm from the reference position. In this case, the value of the variable total has not reached the constant WT=34 mm yet, and therefore, the processing to add the value of the variable total is continued. In the case where x=1, the value of the LUT (x) is 137, and therefore, the value of the next variable total will be 0.058+137/100*0.84*0.05=0.115 mm. Consequently, it is known that the position in the case where x=2 is the position having advanced 0.115 mm from the reference position. In this case also, the value of the variable total has not reached the constant WT=34 mm yet, and therefore, the processing to add the value of the variable total is further continued. In this manner, the processing is repeated until the value of the variable total reaches the value of the constant WT and the value of the variable x representing the target pixel position at the time of end of this flow will be the scanning position adjustment amount to be found. However, the value of the variable x that is found here is in the unit of VCLK, and therefore, the value of the variable x is multiplied by 16 in order to obtain the number of cycles of the clock (VCLK×16) the frequency of which has been multiplied and the result of the multiplication is taken to be the final scanning position adjustment amount. It may also be possible to prepare the scanning speed profile in the unit of the clock (VCLK×16) the frequency of which has been multiplied and to take the period T to be the period of the clock (VCLK×16) the frequency of which has been multiplied. Due to this, it is possible to find the scanning position adjustment amount with a higher accuracy. By finding the adjustment amount that has taken into consideration the scanning speed at each scanning position as described above, it is made possible to omit the process, such as the process to measure the time taken for the movement from the BD sensor to the printing medium end for each printing medium.

The scanning speed profile, the partial magnification characteristic information, and the scanning position adjustment amount obtained by the information processing apparatus 1200 are input to the image forming apparatus via the external I/F 1207 and stored in the memory 301 (see FIG. 5) of the laser drive unit 300 within the image forming apparatus. Then, in the image forming apparatus, the CPU 102 of the image signal generation unit 100 acquires the scanning position adjustment amount stored in the memory 301 via the control unit 200 and applies the acquired scanning position adjustment amount to the output control of the VDO signal from the FIFO 125 of the image modulation unit 101. The adjustment method of the output start position of the VDO signal is the same as that explained in FIG. 10A and FIG. 10B.

In the present embodiment, the scanning position adjustment amount in accordance with the size of a printing medium is derived, but the present invention is not limited to the aspect such as this. For example, it may also be possible to adjust the write position of data to an internal buffer (buffer corresponding to the width of the largest-sized paper) in accordance with the size of a printing medium (in this case, all the pixel positions where data is not written are treated as a white pixel), and to use a fixed value in accordance with the size of the largest paper as the scanning position adjustment amount itself. In this case, the buffer size inside the FIFO 125 is the largest main scanning width (corresponding to the width of the largest-sized paper) and the storage position of pixel data into the buffer (write position) is adjusted in accordance with the output paper size and the image data size. That is, write to the line buffer is performed from the position where the center of the recording medium is the same as the center of the buffer. Then, the pixel at the position where write is not performed is treated as a white pixel with the initial value. After this, at the time of read from the FIFO 125, position adjustment in accordance with the largest paper size is made and the output is produced from the pixel at the front of the line buffer.

As above, according to the present embodiment, in the electrophotographic image forming apparatus in which the scanning speed of laser beam is not fixed on the photoconductor surface, it is made possible to specify the scanning start position without deviation, and therefore, it is possible to reduce the deviation in the printing position with a high accuracy.

Second Embodiment

The first embodiment is the aspect in which the derivation of the scanning position adjustment amount is performed in the information processing apparatus, not in the image forming apparatus, and the obtained derivation results are set to the image forming apparatus. However, there is a possibility that the scanning position adjustment amount for aligning the center of the print image with the center of the drum changes due to the deviation in the mount position of each part resulting from vibrations or the like in the image forming apparatus, the deterioration with the passage of time, abrasion, etc. Consequently, an aspect is explained as a second embodiment in which an appropriate scanning position adjustment amount is derived by the image forming apparatus alone and it is possible to adjust the scanning position adjustment amount in accordance with the necessity.

The contents of the portions (the outline diagram of the image forming apparatus, the configurations of the optical scanning device and the image modulation unit) in common to those of the first embodiment are omitted or simplified and in the following, different points, such as the configuration of exposure control and the scanning position adjustment amount derivation processing, are explained mainly.

Figure 17:
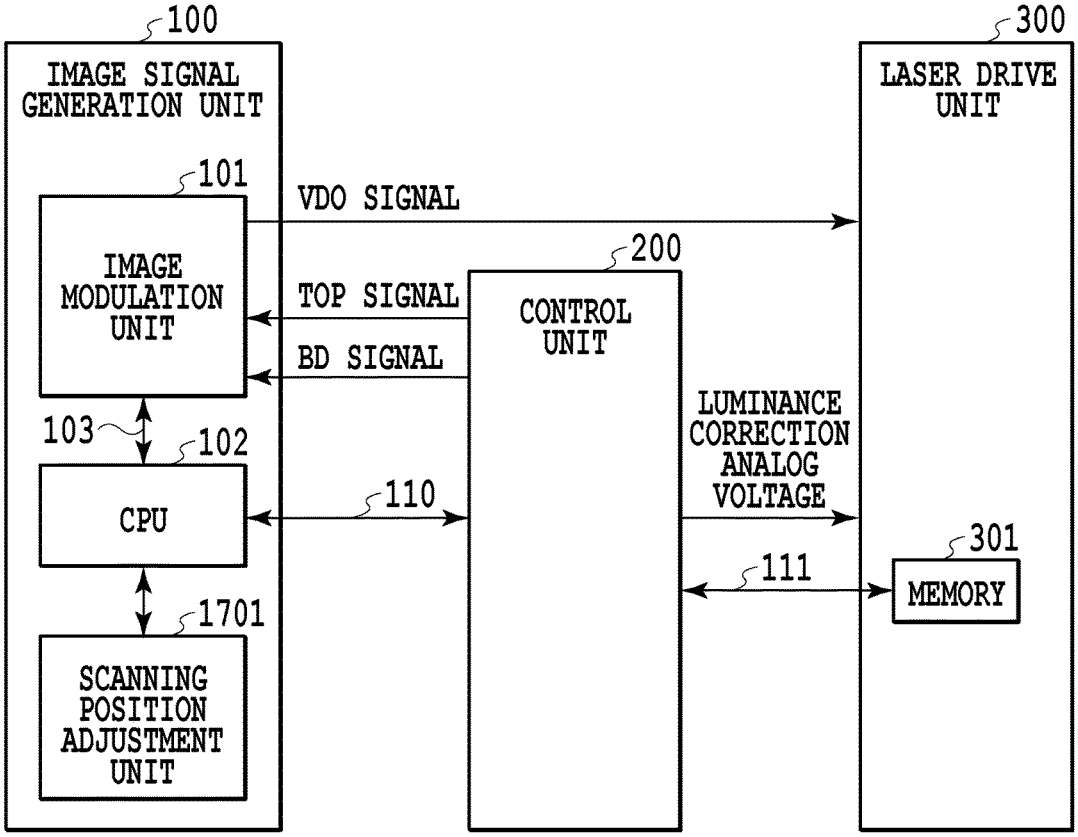
FIG. 17 is a block diagram showing details of a portion in charge of exposure control in an image forming apparatus according to a second embodiment.

FIG. 17 is a block diagram showing details of the portion in charge of exposure control in the image forming apparatus according to the present embodiment. Compared with the block diagram in FIG. 5 of the first embodiment, a scanning position adjustment unit 1701 is added to the image signal generation unit 100.

<Scanning Position Adjustment Unit>

The scanning position adjustment unit 1701 performs the setting of the scanning position adjustment amount again by performing calibration processing, to be described later, as well as performing the scanning position adjustment amount derivation processing described previously within the image forming apparatus. The scanning position adjustment unit 1701 derives a scanning position adjustment amount by referring to the scanning speed profile stored in the memory 301. The access to the memory 301 is performed by the CPU 102 via the control unit 200. The processing to derive a scanning position adjustment amount by using the scanning speed profile acquired from the memory 301 is the same as that of the flow in FIG. 15 of the first embodiment. The derived scanning position adjustment amount is stored in the memory 301 in a factory or the like at the time of assembling of the image forming apparatus as the initial value along with the scanning speed profile and the partial magnification characteristic information described previously.

The scanning position adjustment amount derivation processing and the calibration processing, to be described later, are implemented by, for example, the CPU 102 executing programs stored in a nonvolatile memory, not shown.

<Calibration Processing>

Figure 18:
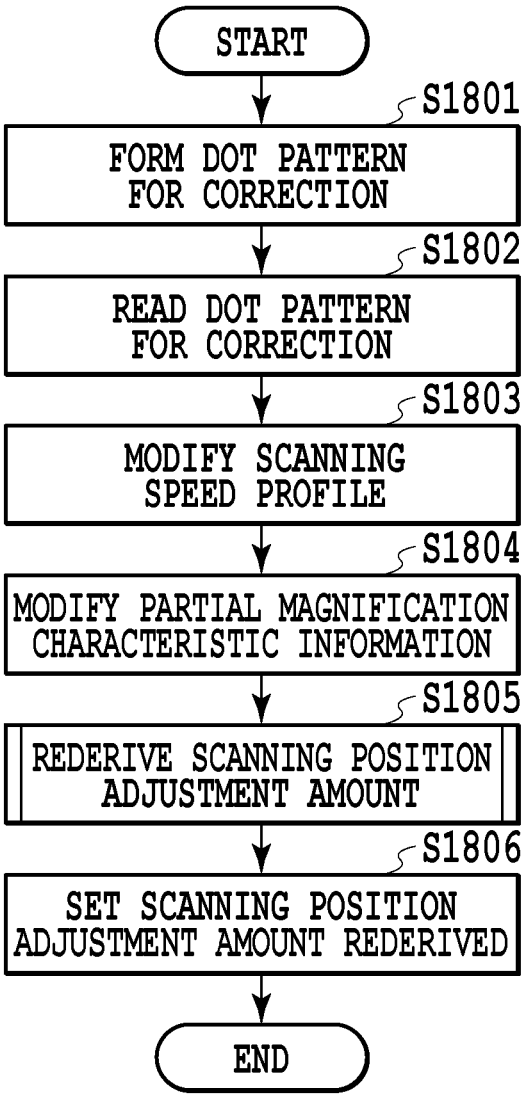
FIG. 18 is a flowchart showing a flow of calibration processing according to the second embodiment.

Subsequently, explanation is given as to the processing (calibration processing) to regenerate the scanning speed profile and to change the partial magnification characteristic information and the scanning position adjustment amount in accordance with the regenerated scanning speed profile, which is the feature of the present embodiment. This calibration processing is performed appropriately under predetermined conditions in the state where the image forming apparatus is not performing image forming processing based on a print job (the idle state). As the predetermined conditions, mention is made, for example, of the elapse of a certain time and the number of times of processing of the pint job reaching a predetermined number. It may also be possible to design the configuration so that the calibration processing is started in accordance with the explicit instructions from a user. FIG. 18 is a flowchart showing a flow of the calibration processing according to the present embodiment.

At step 1801, a dot pattern for correction is formed. Specifically, by using the optical scanning device 400, a latent image of a dot pattern with which it is possible to identify a difference between toner images due to the scanning speed as explained in FIG. 7 is formed on both the main scanning ends of the photoconductor drum 500. Then, by forming a toner image corresponding to the latent image formed by the developing device (not shown), a dot pattern for correction is formed on the photoconductor drum 500.

At step 1802, the dot pattern for correction formed on the photoconductor drum 500 is read. For example, a sensor for measuring the width of each dot in the dot pattern for correction is placed at a position corresponding to each of both the main scanning ends, and thereby, the width of each dot is measured by the sensor. Based on the information about the width of each dot obtained in this manner, the scanning speed at both the main scanning ends is estimated.

Alternatively, it may also be possible to provide a sensor for measuring the density of each dot at the same position and to estimate the scanning speed at both the main scanning ends based on the density obtained by the sensor. It is possible to estimate the scanning speed at both the main scanning ends by measuring the density that changes in accordance with a reduction in the total exposure amount per unit length in the vicinity of the outermost off-axis image height. It may also be possible to estimate the scanning speed at each position with a higher accuracy by, for example, designing a configuration in which both the kinds of sensor described above are placed and the width and the density of each dot are measured. However, providing a larger number of sensors will raise the cost accordingly, and therefore, the number of sensors should be determined by taking into consideration the balance with the cost.

At step 1803, based on the results of reading the dot pattern for correction read at step 1802 (here, the information about the width of each dot), the scanning speed profile stored in the memory 301 is modified. Specifically, first, the scanning speed at the sensor position (here, the position corresponding to both the main scanning ends) is estimated from the information about the width of each dot obtained by the read. The scanning speed at both the main scanning ends is estimated by, for example, storing in advance the width of a dot that is obtained in the case where the dot pattern for correction is formed at the main scanning center as a reference value (e.g., 100) and by finding the magnitude of the width of a dot that is read with respect to the reference value. Alternatively, it may also be possible to estimate the scanning speed by finding the magnitude of the dot width with respect to a dot pattern for correction as a reference in which the main scanning center has a width of one dot of 600 dpi (42.3 μm). Next, a difference between the estimated scanning speed and the scanning speed stored in the current scanning speed profile is found and the scanning speed profile is modified. For example, on the assumption that a possibility that the slope itself of the curve of the scanning speed profile (see FIG. 3 described previously) changes with the passage of time is faint, the modified scanning speed profile is obtained by translating the position of the curve of the current scanning speed profile based on the difference in the scanning speed that is found. In detail, in the case where both the differences at both the main scanning ends are positive (both the partial magnifications at both ends increase), the position of the curve is shifted in the downward direction and in the case where both the differences are negative (both the partial magnifications at both ends decrease), the position of the curve is shifted in the upward direction. In the case where one of the differences at both the main scanning ends is positive and the other is negative, the position of the curve is shifted horizontally (to the left or right) toward the side on which the negative difference is detected. These shift directions premise that the curve is convex in the downward direction. Of course, it is also possible to finely modify the curve itself in accordance with the necessity in such a case where the difference in the scanning speed that is found is large. The modified scanning speed profile is stored in the memory 301 and the scanning speed profile before the modification is replaced with the modified scanning speed profile.

At step 1804, following the modification of the scanning speed profile, the partial magnification characteristic information is modified. The partial magnification characteristic information is also modified because in the case where the contents of the scanning speed profile change, the partial magnification characteristics also change. This modification is the processing to regenerate the characteristic information from the scanning speed profile, which indicates at which position in the main scanning direction the magnification correction of the image is necessary in the magnification correction by inserting bit data or deleting bit data described previously. The contents of the processing are the same as those of the processing in the partial magnification characteristic information generation module 1303 described in the first embodiment. The modified partial magnification characteristic information is stored in the memory 301 and the partial magnification characteristic information before the modification is replaced with the modified partial magnification characteristic information.

At step 1805, the scanning position adjustment amount is rederived. This is implemented by the CPU 102 performing the scanning position adjustment amount derivation processing again based on the scanning speed profile modified at step 1803. The processing to derive a new scanning position adjustment amount by reading the modified scanning speed profile from the memory 301 is the same as that of the flow in FIG. 15 of the first embodiment, and therefore, explanation thereof is omitted here.

At step 1806, the scanning position adjustment amount rederived at step 1805 is set to the FIFO 125 in charge of adjusting the scanning position. The modified partial magnification characteristic information is also set to the magnification control unit 126.

The above is the contents of the calibration processing according to the present embodiment. Due to this, it is made possible to form an image of high quality in accordance with the change in the scanning speed profile.

As above, according to the present embodiment, by appropriately performing the calibration processing, an appropriate scanning position adjustment amount is set again. Due to this, it is made possible to cause an electrophotographic image forming apparatus in which the scanning speed of laser beam is not fixed on the photoconductor surface to have resistance to a change with the passage of time.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present invention, it is made possible to reduce the deviation in the scanning start position in the case where an image is formed by the electrophotographic scheme in which the scanning speed of laser beam is not fixed on the photoconductor surface.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-172138 filed Sep. 1, 2015, and No. 2016-138498 filed Jul. 13, 2016, which are hereby incorporated by reference wherein in their entirety.

What is claimed is:

1. An information processing apparatus comprising:

a generation unit configured to generate a scanning speed profile, which is information about a scanning speed for each main scanning position in a main scanning direction of a laser beam which scans a photoconductor surface; and a derivation unit configured to derive a scanning position adjustment amount specifying a distance from a reference position in the main scanning direction of the laser beam to a write start position of the laser beam to the photoconductor surface based on the generated scanning speed profile in the main scanning direction.

2. The information processing apparatus according to claim 1, wherein the derivation unit derives the scanning position adjustment amount by finding a distance to be scanned per unit time at each main scanning position from the scanning speed profile and by referring to a distance from the reference position to the write start position of the laser beam to the photoconductor surface.

3. The information processing apparatus according to claim 2, wherein the unit time is one period of a clock used to form a latent image in an image forming apparatus.

4. The information processing apparatus according to claim 1, wherein the scanning position adjustment amount is represented by a number of clocks generated by a clock, wherein the number of clocks is the number of clocks, which is used to form a latent image in an image forming apparatus, necessary from the reference position to the write start position of the laser beam to the photoconductor surface.

5. The information processing apparatus according to claim 4, wherein the scanning speed profile is a lookup table in which information about a partial magnification for each main scanning position is stored, and the derivation unit derives the scanning position adjustment amount based on the partial magnification for each main scanning position in the lookup table, a scanning speed at a center position in a scanning area of the laser beam in the main scanning direction, and a period of the clock.

6. An image forming apparatus in which a scanning speed of a laser beam is not uniform in a main scanning direction on a photoconductor surface, the image forming apparatus comprising:

a memory storing a scanning speed profile, which is information about a scanning speed for each main scanning position in the main scanning direction of the laser beam which scans the photoconductor surface; and a scanning position adjustment amount derivation unit configured to derive a scanning position adjustment amount specifying a distance from a reference position in the main scanning direction of the laser beam to a write start position of the laser beam to the photoconductor surface based on the scanning speed profile in the main scanning direction.

7. The image forming apparatus according to claim 6, wherein the scanning position adjustment amount derivation unit derives the scanning position adjustment amount by finding a distance to be scanned per unit time at each main scanning position from the scanning speed profile and by referring to a distance from the reference position to the write start position of the laser beam to the photoconductor surface.

8. The image forming apparatus according to claim 7, wherein the unit time is one period of a clock used to form a latent image in the image forming apparatus.

9. The image forming apparatus according to claim 6, wherein the scanning position adjustment amount is represented by a number of clocks generated by a clock, wherein the number of clocks is the number of clocks, which is used to form a latent image in the image forming apparatus, necessary from the reference position to the write start position of the laser beam to the photoconductor surface.

10. The image forming apparatus according to claim 9, wherein the scanning speed profile is a lookup table in which information about a partial magnification for each main scanning position is stored, and the scanning position adjustment amount derivation unit derives the scanning position adjustment amount based on a value of the partial magnification for each main scanning position in the lookup table, a scanning speed at a center position in a scanning area of the laser beam in the main scanning direction, and a period of the clock.

11. The image forming apparatus according to claim 6, further comprising:

a calibration unit configured to rederive the scanning position adjustment amount.

12. The image forming apparatus according to claim 11, wherein the calibration unit includes:

a unit configured to modify the scanning speed profile; and a unit configured to change the scanning position adjustment amount in accordance with a modified scanning speed profile.

13. The image forming apparatus according to claim 11, wherein the calibration unit automatically performs the rederivation after an elapse of a predetermined time.

14. The image forming apparatus according to claim 11, wherein the calibration unit automatically performs the rederivation in a case where a number of times of processing of a print job reaches a predetermined number of times.

15. The image forming apparatus according to claim 11, further comprising:

a user interface that receives instructions from a user, wherein the calibration unit performs the rederivation in accordance with user instructions via the user interface.

16. The image forming apparatus according to claim 6, comprising:

an optical scanning device that uses a lens not having fθ characteristics.

* * * * *